US007798164B2

(12) United States Patent
Adleman et al.

(10) Patent No.: US 7,798,164 B2
(45) Date of Patent: Sep. 21, 2010

(54) PLASMON ASSISTED CONTROL OF OPTOFLUIDICS

(75) Inventors: James Adleman, Pasadena, CA (US); David A. Boyd, Pasadena, CA (US); David G. Goodwin, Pasadena, CA (US); Demetri Psaltis, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 129 days.

(21) Appl. No.: 12/020,504

(22) Filed: Jan. 25, 2008

(65) Prior Publication Data

US 2008/0245430 A1 Oct. 9, 2008

Related U.S. Application Data

(60) Provisional application No. 60/897,743, filed on Jan. 26, 2007, provisional application No. 60/966,402, filed on Aug. 28, 2007.

(51) Int. Cl.
*F15C 1/04* (2006.01)

(52) U.S. Cl. ..... 137/1; 417/53; 417/207; 137/828

(58) Field of Classification Search ..... 137/802, 137/803, 825, 827, 828, 1; 417/207, 208, 417/53

See application file for complete search history.

(56) References Cited

U.S. PATENT DOCUMENTS 7,439,014 B2 * 10/2008 Pamula et al. ..... 435/4
2003/0006140 A1 1/2003 Vacca et al.
2003/0226604 A1 * 12/2003 Schlautmann et al. ..... 137/827
2006/0072113 A1 4/2006 Ran et al.
2006/0275179 A1 12/2006 Viovy et al.
2008/0118790 A1 * 5/2008 Kim et al. ..... 429/13
2008/0159351 A1 * 7/2008 Li et al. ..... 372/53

OTHER PUBLICATIONS

Liu G L, Kim J, Lu Y, Lee L P, "Optofluidic control using photothermal nanoparticles" Nat Mater. Jan. 2006;5(1):27-32. Epub Dec. 18, 2005.*

(Continued)

*Primary Examiner*—John Rivell
*Assistant Examiner*—William McCalister
(74) *Attorney, Agent, or Firm*—Townsend and Townsend and Crew LLP

(57) ABSTRACT

A method of microfluidic control via localized heating includes providing a microchannel structure with a base region that is partially filled with a volume of liquid being separated from a gas by a liquid-gas interface region. The base region includes one or more physical structures. The method further includes supplying energy input to a portion of the one or more physical structures within the volume of liquid in a vicinity of the liquid-gas interface region to cause localized heating of the portion of the one or more physical structures. The method also includes transferring heat from the portion of the one or more physical structures to surrounding liquid in the vicinity of the liquid-gas interface region and generating an interphase mass transport at the liquid-gas interface region or across a gas bubble while the volume of liquid and the gas remain to be substantially at ambient temperature.

19 Claims, 21 Drawing Sheets

OTHER PUBLICATIONS

Govorov A O, Zhang W, Skeini T, Richardson H, Lee J, Kotov N A, "Gold nanoparticle ensembles as heaters and actuators: melting and collective plasmon resonances" Nanoscale Research Letters Jul. 2006;1:84-90.*

Wootton R C R, deMello A J, "Continuous laminar evaporation: micron-scale distillation" Chemical communications 2004;3:266-267.*

PCT Search Report and PCT Written Opinion of Application No. PCT/US08/01124, date of mailing Jun. 24, 2008, 10 pages total.

* cited by examiner (A)

(B)

PLASMON ASSISTED CONTROL OF OPTOFLUIDICS

CROSS-REFERENCES TO RELATED APPLICATIONS

This application claims priority of U.S. Patent Application No. 60/897,743, and titled "PLASMON ASSISTED CONTROL OF OPTOFLUIDICS," filed by Adleman et al. at Jan. 26, 2007 and claims priority to U.S. Patent Application No. 60/966,402, and titled "METHOD FOR MICROFLUIDIC DISTILLATION AND SAMPLE CONCENTRATION," filed by Adleman et al. at Aug. 28, 2007 commonly assigned, and each of which is incorporated by reference in its entirety.

STATEMENT AS TO RIGHTS TO INVENTIONS MADE UNDER FEDERALLY SPONSORED RESEARCH OR DEVELOPMENT

The U.S. Government has certain rights in this invention pursuant to Grant No. HR0011-04-1-003267 awarded by DARPA and Grant No. N00014-06-1-0454 awarded by the Office of Naval Research.

REFERENCE TO A "SEQUENCE LISTING," A TABLE, OR A COMPUTER PROGRAM LISTING APPENDIX SUBMITTED ON A COMPACT DISK

Not Applicable

BACKGROUND OF THE INVENTION

The present invention relates generally to microfluidic control techniques. In particular, the present invention provides a method of plasmon assisted optofluidics using a laser. More particularly, the present invention provides a method for optically controlling fluid in a microchannel using a plasmon resonance in fixed arrays of nanoscale metal structures to produce localized evaporation of the fluid when illuminated by a stationary, low power laser. Merely by way of example, the invention has been applied to drag the surface of the fluid, drive evaporative pumping, and provide intra-channel distillation and sample concentration, but it would be recognized that the invention has a much broader range of applicability.

Current microfluidics is realized through pumping, which is an excellent means for transport, mixing, and metering. Ideally, this and other complex functionalities would occur directly on-chip. However, the majority of microfluidic systems employ off-chip, mechanical pumps combined with valve networks to direct fluid flow. Electro-kinetic transport can be more compact and flexible, but it depends on liquid conductivity and requires large voltages and a fabrication method that integrates the fluidic and electronic circuitry. Electrowetting based devices have great utility, but are most naturally limited to discrete, droplet based devices.

Recently there has been increased interest in using optical transport methods for microfluidics. This approach uses optical beams to induce flow without connected pumps or electrical circuitry. An example is photothermal transport by resonant heating of nanoparticles in solution, which can be used to control the position of the free surface of a fluid along a complex circuit without the need for valves. Although it can be arbitrarily applied anywhere on a chip, however, this method requires that the optical beam be translated to transport the fluid. Furthermore, it may not be desirable or possible to have nanoparticles freely suspended in liquid solution, because the changing concentration of the suspended nanoparticles makes difficult for controlling the flow rate for a given laser power.

Another aspect regarding the fluid pumping in a microchannel involves interphase mass transfer. A conventional method uses a series of heaters, which are typically embedded in the channel, to produce a vapor bubble as well as a thermal gradient between the two ends of the bubble. Mass-transfer occurs as fluid on the warmer interface is vaporized and then condensed on the cooler side. In addition to pumping, vapor mass-transfer provides a simple means to separate both soluble and insoluble components of a mixture. However, although it can be applied on-chip, this method requires the high temperatures to create and to prevent the collapse of the vapor bubble and precludes many applications, especially biological ones.

From above, it is seen that there is a need in the art for an improved method and system for controlling fluid in a microchannel structure with on-chip functionality for pumping, distillation, and sample concentration based on ambient temperature interphase mass-transfer.

BRIEF SUMMARY OF THE INVENTION

The present invention relates generally to microfluidic control techniques. In particular, the present invention provides a method of plasmon assisted optofluidics using a laser. More particularly, the present invention provides a method for optically controlling fluid in a microchannel using a plasmon resonance in fixed arrays of nanoscale metal structures to produce localized evaporation of the fluid when illuminated by a stationary, low power laser. Merely by way of example, the invention has been applied to drag the surface of the fluid, drive evaporative pumping, and provide intra-channel distillation and sample concentration, but it would be recognized that the invention has a much broader range of applicability.

In a specific embodiment, the present invention provides a method of microfluidic control using plasmon assisted heating. The method includes providing a microchannel structure with a base region. The microchannel structure is partially filled with a volume of liquid and a gas at an ambient temperature. The volume of liquid and the gas are separated by a liquid-gas interface region at a first position of the microchannel structure. The base region includes one or more physical structures. Additionally, the method includes supplying energy input to a portion of the one or more physical structures within the volume of liquid in a vicinity of the liquid-gas interface region to cause localized heating of the portion of the one or more physical structures. The method further includes transferring heat from the portion of the one or more physical structures to surrounding liquid in the vicinity of the liquid-gas interface region. Furthermore, the method includes generating an interphase mass transport at the liquid-gas interface region in the microchannel structure. The volume of liquid and the gas remain to be substantially at the ambient temperature during the interphase mass transport.

In another specific embodiment, the present invention provides a method of plasmon resonance assisted microfluidic pumping. The method includes providing a vessel partially filled with a first volume of liquid. The first volume of liquid is separated from a gas by a first liquid-gas interface region. The vessel characterized in micrometer scale includes a base region, a width, and a height. The base region includes an array of nanometer structures associated with a plasmon resonance frequency range. Additionally, the method includes illuminating a laser beam on a portion of the array of nanometer structures within the first volume of liquid substantially near the first liquid-gas interface region. The laser beam is characterized by a power level and a determined frequency within the plasmon resonance frequency range to cause plasmon resonance excitation of the portion of the array of nanometer structures. The method further includes entrapping a gas bubble in the vessel by forming a second volume of liquid at a distance in front of the first liquid-gas interface region through evaporation and recondensation during an energy transfer facilitated by the plasmon resonance excitation. The gas bubble is bounded by the first liquid-gas interface region, surrounding inner walls of the vessel, and a second liquid-gas interface region associated with the second volume of liquid. Furthermore, the method includes generating a mass transport in the vessel across the gas bubble from first liquid-gas interface region to the second liquid-gas interface region.

In certain embodiment, generating a mass transport in the vessel across the gas bubble from first liquid-gas interface region to the second liquid-gas interface region further includes a step of illuminating the laser beam on the portion of the array of nanometer structures within the first volume of liquid near the first liquid-gas interface region; and a step of transforming heat at least partially to a latent heat of evaporation of a portion of the first volume of liquid at the first liquid-gas interface region while keeping temperature increase of the portion of the first volume of liquid less than 2 degrees of Centigrade; and a step of converting the portion of the first volume of liquid to a vapor into the gas bubble; and a step of thereafter condensing the vapor at the second liquid-gas interface region. In one embodiment, the laser beam is substantially stationary relative to the vessel and the first liquid-gas interface region. In another embodiment, the gas bubble keeps a substantially stable size defined by a spacing between the first liquid-gas interface region and the second liquid-gas interface region during the mass transport in the vessel after an earlier shrinkage within a certain amount of time of illuminating the laser beam. In yet another embodiment, the stable size of the gas bubble corresponds to a steady state pumping rate for the mass transport from the first volume of liquid to the second volume of liquid. In yet still another embodiment, the steady state pumping rate is substantially constant with time and linear with the power level of laser beam.

In an alternative embodiment, the present invention provides a method of concentrating a volume of liquid mixture in a microfluidic system. The method includes providing a vessel partially filled with a first volume of liquid mixture separated from a gas by a first liquid-gas interface region. The liquid mixture includes at least a first substance in a first concentration and a second substance in a second concentration. The first substance is characterized by a first volatility and the second substance is characterized by a second volatility. The second volatility is less than the first volatility. The vessel characterized in micrometer scale includes a base region. The base region including an array of nanometer structures associated with a plasmon resonance frequency range. Additionally, the method includes illuminating a laser beam on a portion of the array of nanometer structures within the first volume of liquid mixture substantially near the first liquid-gas interface region. The laser beam is characterized by a determined frequency within the plasmon resonance frequency range to cause plasmon resonance excitation of the portion of the array of nanometer structures. The method further includes entrapping a gas bubble in the vessel by forming a second volume of liquid mixture at a distance in front of the first liquid-gas interface region through evaporation and recondensation during an energy transfer facilitated by the plasmon resonance excitation. The gas bubble is bounded by the first liquid-gas interface region, surrounding inner walls of the vessel, and a second liquid-gas interface region associated with the second volume of liquid mixture. Moreover, the method includes illuminating the laser beam on a portion of the array of nanometer structures within the first volume of liquid mixture substantially near the first liquid-gas interface region to generate a first mass flow for the first substance with a first flow rate and a second mass flow for the second substance with a second flow rate in the vessel across the gas bubble from first volume of liquid mixture to the second volume of liquid mixture. The first flow rate is higher than the second flow rate. The method further includes concentrating the second substance in the first volume of liquid mixture while maintaining the first volume of liquid mixture substantially at an ambient state during fractional increase of the second concentration and decrease of the first concentration. Furthermore, the method includes distillating the first substance in the second volume of liquid mixture being substantially free of the second substance.

In another alternative embodiment, the present invention provides a method of concentrating a substance within a volume of liquid in a microfluidic system. The method includes providing a vessel partially filled with a first volume of liquid separated from air by a first liquid-air interface region in an ambient state. The first volume of liquid includes a first concentration of a substance characterized as a plurality of suspended molecules. The vessel characterized in micrometer scale includes a base region. The base region includes an array of metal nanoparticles associated with a plasmon resonance frequency range. Additionally, the method includes illuminating a laser beam on a portion of the array of metal nanoparticles within the first volume of liquid substantially near the first liquid-air interface region. The laser beam is characterized by a determined frequency within the plasmon resonance frequency range to cause plasmon resonance excitation of the portion of the array of metal nanoparticles. The method further includes entrapping an air bubble in the vessel by forming a second volume of liquid at a distance in front of the first liquid-air interface region through liquid evaporation and recondensation during an energy transfer facilitated by the plasmon resonance excitation. The air bubble is bounded by the first liquid-air interface region, surrounding inner walls of the vessel, and a second liquid-air interface region associated with the second volume of liquid. Moreover, the method includes illuminating the laser beam on a portion of the array of metal nanoparticles within the first volume of liquid substantially near the first liquid-air interface region to generate a mass flow for the liquid in the vessel across the air bubble from the first liquid-air interface region to the second liquid-air interface region. Furthermore, the method includes concentrating the substance suspended within the first volume of liquid to increase the first concentration to a second concentration while maintaining the first volume of liquid substantially at an ambient state.

Many benefits are achieved by way of the present invention over conventional techniques. For example, the present invention provides a new class of on-chip functionality for microfluidics based on ambient temperature interphase mass-transfer. Embodiments of the present invention avoid high temperatures by using of the freedom provided by microfluidics to heat liquid in the immediate vicinity of a liquid-vapor interface. In some embodiments, only a small change in the temperature, for example less than 2 degree of Centigrade, of the fluid is required for the observed mass-transfer rates. Another advantage of the present invention lies in using plasmon assisted heating by illuminating a laser beam and is highly controllable. Certain embodiments of the present invention provide an array of nano-metal particles fixed or embedded in the base region of the microchannel structure by taking advantage of well-established soft lithography technique for easy fabrication of large-scale and quasi-ordered nanostructures. The embedded nanostructures offers a natural on-chip functionality to provide controllable plasmonic heating through plasmon resonance excitation by a laser beam. In addition, unlike other optical transport methods, it does not require translation of the laser beam. By using a novel bubble assisted interface mass-transfer method a stationary and constant powered laser beam can be used to induce plasmonic heating and produce a stable mass flow rate. Advances in microelectronic fabrication should allow for integration of microlasers on chip, and when combined with the present invention to minimize inconsistencies related to the distance of spot position and the surface of the gas bubble will allow opto-controlled microfluidic system to be successfully scaled on microchip. The present invention further provides a simple on-chip means for microfluidic pumping, distillation, and sample concentration. The technique is general and the functionality that it offers can be integrated with conventional microfluidic architectures and is believed to have a much broader range of applicability.

DETAILED DESCRIPTION OF THE INVENTION

The present invention relates generally to microfluidic control techniques. In particular, the present invention provides a method of plasmon assisted optofluidics using a laser. More particularly, the present invention provides a method for optically controlling fluid in a microchannel using a plasmon resonance in fixed arrays of nanoscale metal structures to produce localized evaporation of the fluid when illuminated by a stationary, low power laser. Merely by way of example, the invention has been applied to drag the surface of the fluid, drive evaporative pumping, and provide intra-channel distillation and sample concentration, but it would be recognized that the invention has a much broader range of applicability.

Here we demonstrate a technique of plasmon assisted optofluidics (PAO) according to certain embodiments of the present invention. By incorporating plasmonic resonant structures into a microscale vessel channel, some embodiments show that plasmonic heating allows for dragging of the free surface of the fluid within the vessel channel using a focused, low power laser near a plasmon resonant frequency associated with the plasmonic resonant structures. Furthermore, using PAO certain embodiments of the present invention show methods for on-chip intra-channel pumping and distillation.

To prove the principles and operation of the present invention, we performed various experiments. These experiments have been used to demonstrate the invention and certain benefits associated with the invention. As experiments, they are merely examples, which should not unduly limit the scope of the claims herein. One of ordinary skill in the art would recognize many variations, alternatives, and modifications. Details of these experiments are provided below.

Figure 1:
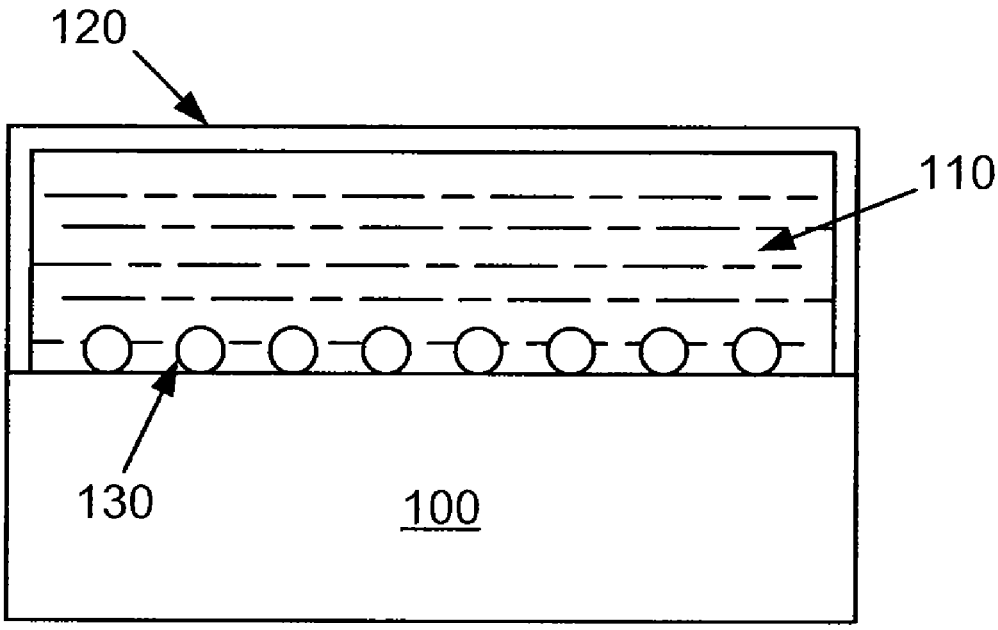
FIG. 1 is a simplified diagram of a microfluidic system including a channel over a base placed with an array of nanoparticles according to an embodiment of the present invention.

FIG. 1 is a simplified diagram of a microfluidic system including a channel over a base placed with an array of nanoparticles according to an embodiment of the present invention. This diagram is merely an example, which should not unduly limit the scope of the claims herein. One of ordinary skill in the art would recognize many variations, alternatives, and modifications. As shown, the microfluidic system includes a channel structure 120 in micrometer scale. For example, the channel structures can be provided by casting from poly-dimethylsiloxane (PDMS) sealed to a base region 100. In one embodiment, a standard microchannel ranged in width from about 20 μm to about 60 μm and the heights all at about 5 μm can be used and sealed to a glass substrate with a prefabricated gold (Au) nanoparticle array (labeled as 130). Then the microchannel is filled (at least partially) with a working fluid. Unless noted otherwise, de-ionized water is used exclusively as the working fluid 110. The array of Au nanoparticles can be created by block-copolymer lithography. The particle size and inter-particle spacing distribution determines a plasmon resonance frequency associated with a strong absorbance band. Details of the fabrication as well as the characterization of the nanoparticle array can be found in a later section of the specification.

Figure 2:
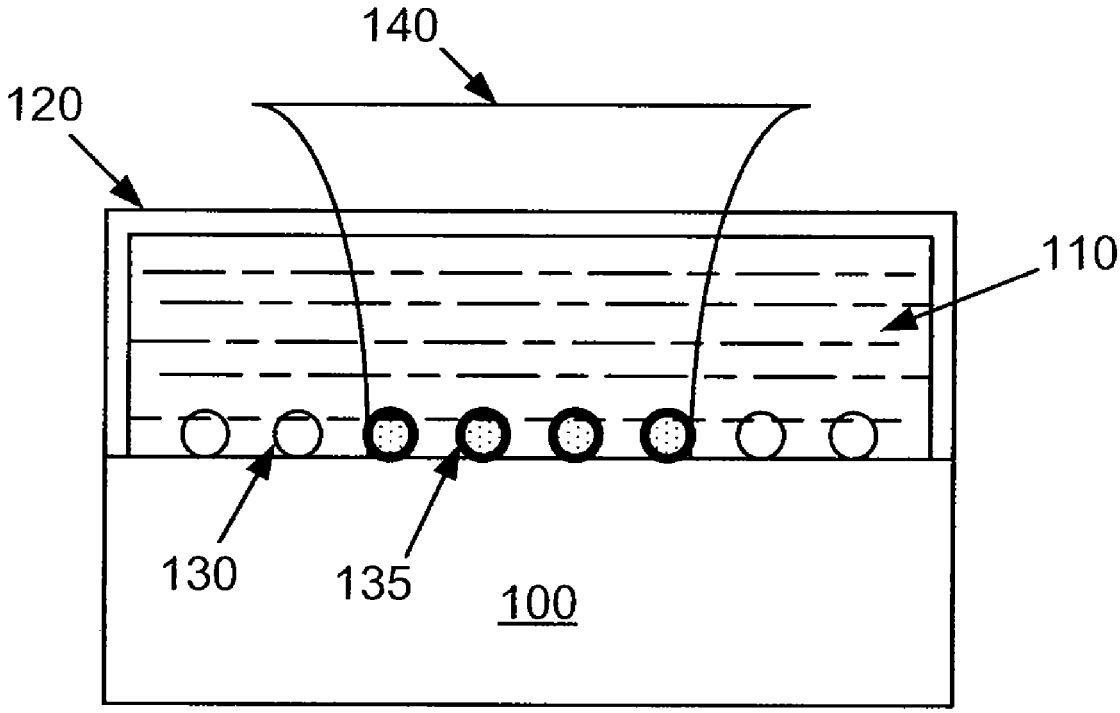
FIG. 2 is a simplified diagram of the microfluidic system showing a laser illuminating the array of nanoparticles on the base according to an embodiment of the present invention.

FIG. 2 is a simplified diagram of the microfluidic system showing a laser illuminating the array of nanoparticles on the base according to an embodiment of the present invention. This diagram is merely an example, which should not unduly limit the scope of the claims herein. One of ordinary skill in the art would recognize many variations, alternatives, and modifications. As shown, a laser beam 140, which is characterized by a determined frequency close to the plasmon resonant frequency, is focused either through the microchannel 120 or the base 100 on the nanoparticles 135 (which are just a portion of all nanoparticles 130 formed on the base 100), causing them to be heated. The heat from the nanoparticles 135 is transferred to the surrounding fluid. For example, A 532 nm laser, which is close to plasmon resonant frequency of the Au nanoparticle arrays, was focused through the glass substrate base onto the Au nanoparticles. The power at the sample is 14 mW and the diameter of the beam spot is about 10 μm. When the laser beam is focused at the base of channel near the liquid-air interface, rapid evaporation from the free surface and re-condensation in the channel are observed. The nucleation of small condensed drops near the contact line causes the free surface to "wet forward" slightly, and by scanning the sample relative to the beam, the fluid can be dragged along the channel. Of course, there can be other alternatives, variations, and modifications.

FIGS. 3A-3D are images showing a fluid being dragged along a channel by a laser beam according to an embodiment of the present invention. These images are merely examples, which should not unduly limit the scope of the claims herein. One of ordinary skill in the art would recognize many variations, alternatives, and modifications. As shown, four still image frames are captured from a video taken during an experiment as a method of microfluidic control using plasmon assisted heating is applied to drag the fluid along the channel (illustrated by two dark lines). The position of the free surface of the fluid (marked by doted line) moves as the laser (bright spot) is translated from left to right following the order of FIG. 3A to FIG. 3D. The movement of the free surface of the liquid can be referenced by a fixed marker (indicated by an arrow) associated with the channel. In this experiment, we found that motion of the fluid along the channel could be made more consistent by using a cylindrical lens to focus the laser beam to a line focus wider than the microchannel rather than a point focus. The maximum dragging rate we observed in a 30 μm channel was approximately 15 μm/s.

In certain embodiments, the maximum dragging speeds are found to be sensitive to the preparation of the substrate. Substrates were rendered 1) highly hydrophobic by treating in hexamethyldisilazane (HDMS) vapor, or 2) hydrophilic by oxygen plasma cleaning. For the hydrophobic channels the maximum dragging rates were not consistent and were slow, typically 5 μm/s, regardless of channel size. This was due to entrapment of air immediately behind the laser as it scanned, which interrupted the fluid motion. The more hydrophilic substrates were able to support higher speeds. When we allowed the hydrophobic channels to age for 2-3 days, we found that their behavior began to resemble that of the hydrophilic channels, i.e. higher maximum flow rates and less occurrence of trapped air bubbles.

Figure 15:
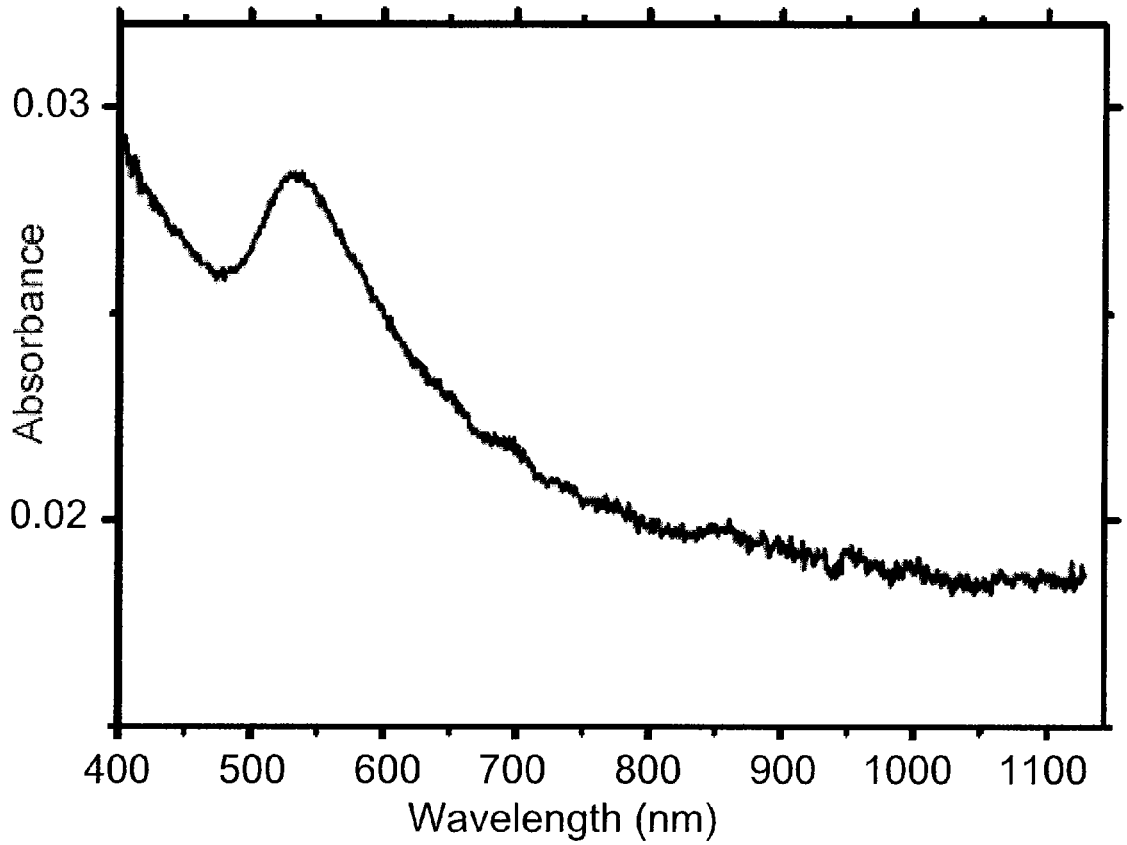
FIG. 15 shows an exemplary absorbance spectrum of the array of nanoparticles according to an embodiment of the present invention.

In other embodiments, the inherent dragging rate increases with increasing laser power used for illuminating the nanoparticle array. In another embodiment, for a given laser power the dragging rate will also be affected by the optical absorbance of the nanoparticle array, which is directly related to the particle size and the inter-particle spacing. Throughout these experiments, arrays with an average particle diameter of about 15 nm and an average inter-particle spacing of about 50 nm are used. The corresponding optical absorbance spectrum of such a typical array is shown in FIG. 15 below. In one specific embodiment, by increasing the diameter and decreasing the inter-particle spacing it should be possible to increase the optical absorption and correspondingly the maximum dragging rates. In another embodiment, the optical transmission spectra of the arrays were taken using a dedicated microscope. The microscope has an additional objective on the condenser lens so that the light is focused on the same surface as the imaging objective. This is important because if both the objectives are not focused, we have found that interference fringes will result in the spectrum. There are also apertures for both objectives allowing good control of the stray light. Apertures of a few millimeters were used. Of course, there are many variations, alternatives, and modifications.

Figure 3:
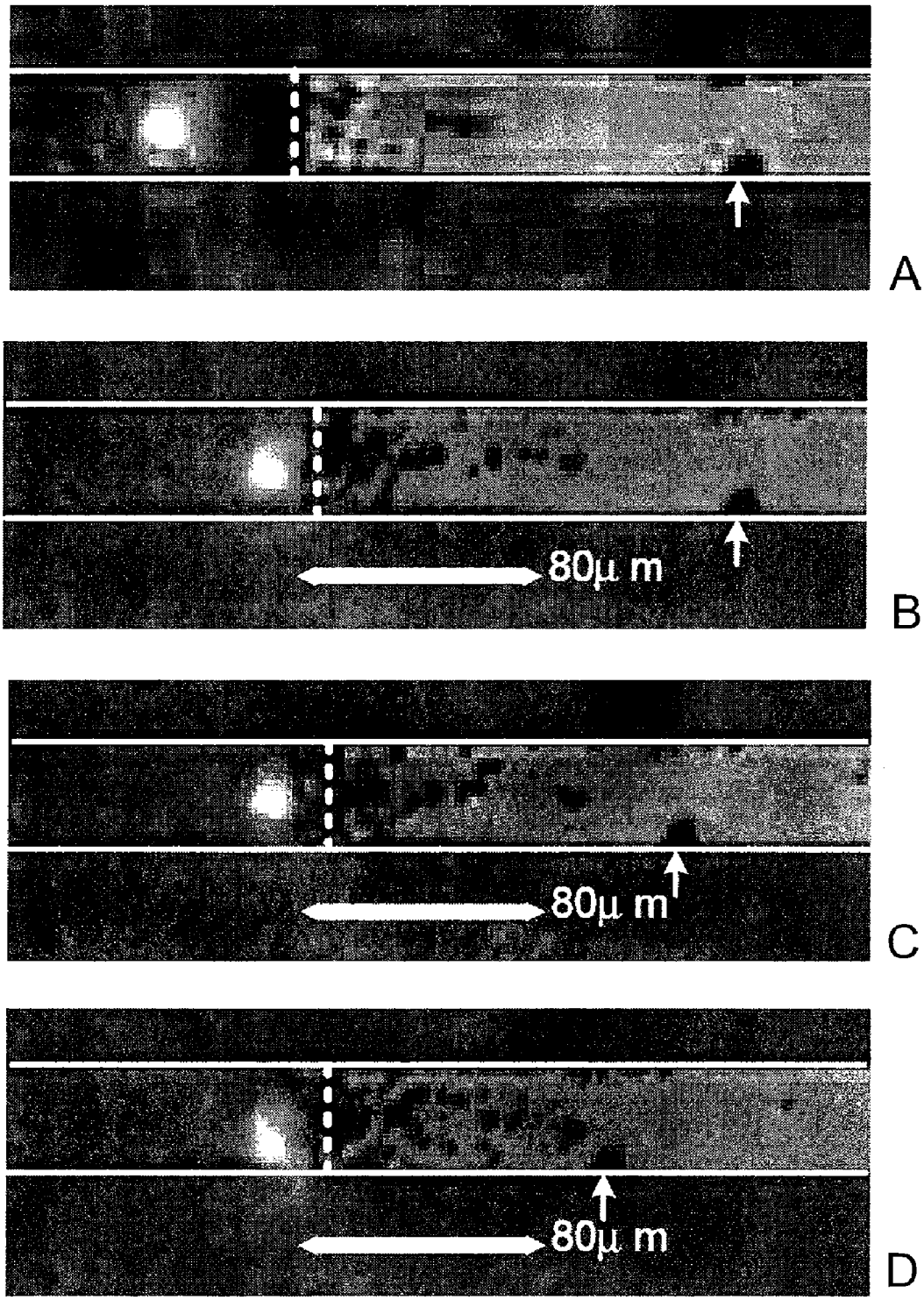
FIGS. 3A-3G are images showing a fluid being dragged along a channel or around a corner by a laser beam according to an embodiment of the present invention.
Figure 3:
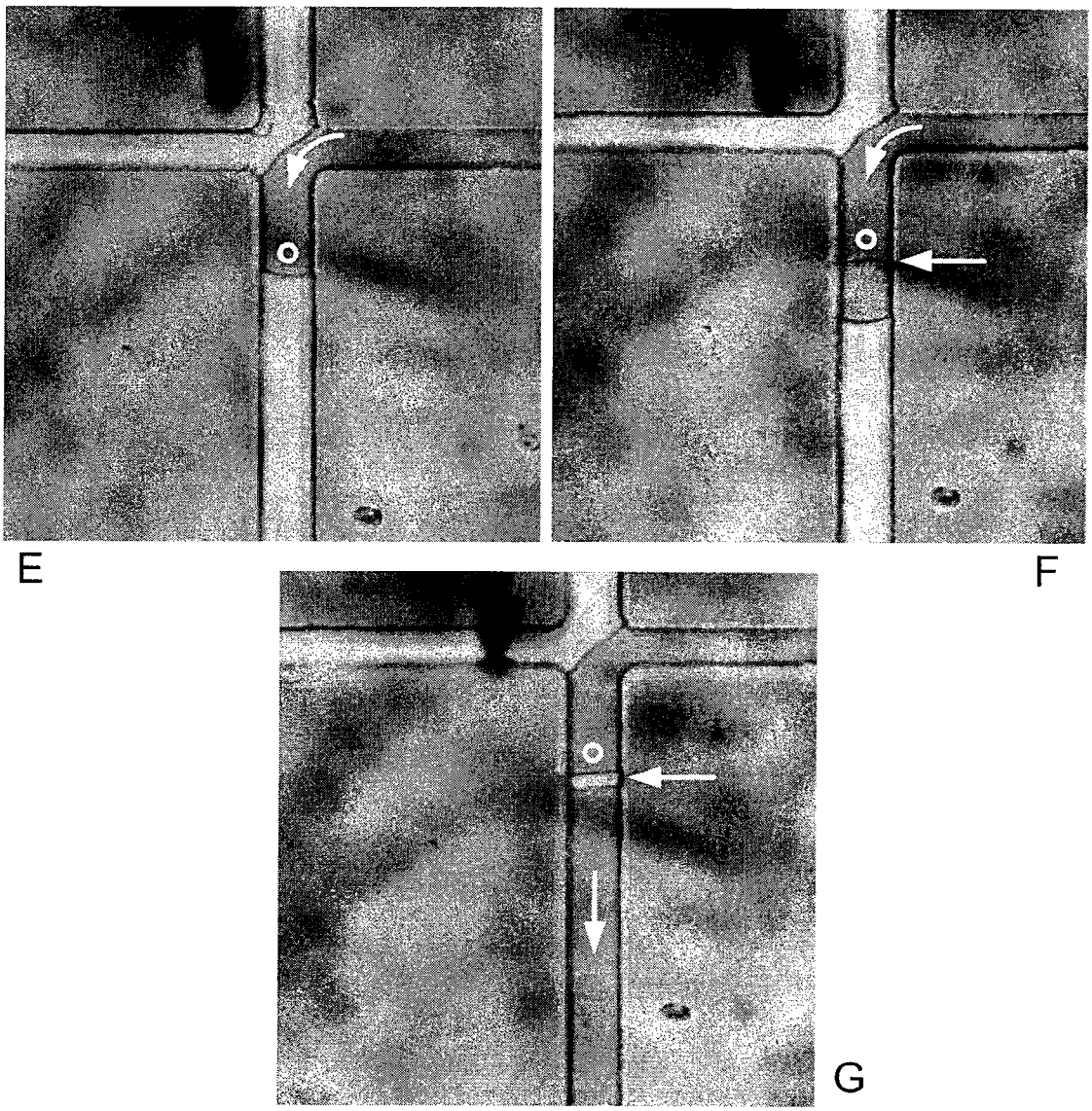

In yet another embodiment, the microfluidic dragging can be combined with a microfluidic pumping process, which will be shown in more details in later sections of this specification. For example, we were also able to drag the fluid around corners using combined dragging and pumping based on the plasmon assisted microfluidics techniques according to certain embodiments of the present invention. FIGS. 3E-3G are a series of images demonstrating how fluid can be dragged/pumped around a corner. These images are merely examples, which should not unduly limit the scope of the claims herein. One of ordinary skill in the art would recognize many variations, alternatives, and modifications. As shown in FIG. 3E, the fluid is first dragged around a corner from right to left, as indicated by a curved arrow. FIG. 3F shows, next, an air bubble is formed in the channel (as pointed by the arrow aside) wherein the position of the laser spot is represented by a black circle. Finally, FIG. 3G shows the fluid is pumped around the corner and moved from top to down in the channel.

In another specific embodiment, the present invention is advantageous over conventional approach by using fixed arrays of nanoparticles to drive the heating instead of suspending nanoparticles randomly in a liquid solution. The advantages relies on the abilities to both spatially pattern the substrate with the nanoparticle arrays using standard lithographic techniques and combine patterning with particles of different resonances. Additional advantages of using fixed array of nanoparticles also allow the creation of a selectable y-junction for mixing where each branch is resonant at a unique wavelength and allow absorbed laser power by these fixed nanoparticles to remain constant during evaporation for achieving a controllable fluid pumping speed during microfluidic control operation. With nanoparticles in solution in some conventional approaches, there would be an increase in the particle density with evaporation and a corresponding increase in the optical absorption. These convention approach would make it difficult to have constant pumping rates for a given laser power, complicate the control of distillation, and prevent sequential distillation steps.

To gain insight into the evaporative mass-transfer mechanism, it is useful to consider a few simple numerical estimates. In one embodiment, we assume equilibrium conditions at the vapor-liquid interface, a constant pressure inside the bubble, and a constant temperature of 25° C. The power P required for evaporative transport is given by $P=J\Delta H$, where $\Delta H$ is the latent heat of vaporization, which for water at 25° C., $\Delta H$ $2.4\times10^{6}$ J/kg. A flow of 5 μm/s of water in a channel 30×5 μm corresponds to $J=7.5\times10^{-13}$ kg/s. The necessary input power P is 1.8 μW. In an embodiment, the measured absorbance A of the nanoparticle arrays at 532 nm is 0.028, and we assume that the scattering from the array of particles is small and that all of the absorbed energy is converted to heat. For 10 mW of input power, this gives 624 μW of power absorbed by the gold nanoparticles, indicating that there is sufficient laser energy available to account for the observed mass-transfer. Clearly the pumping efficiency is low. However, this estimate does not account for temperature changes that would take place in the fluid or the significant heat transfer to the glass substrate and PDMS channel. The estimation results shown here are only for illustrating that the rates of evaporative mass-transfer of the order required for our results. Certain embodiments of the present invention also demonstrate that combined with an appropriate heat transfer model, plasmon assisted evaporative mass-transfer pumping could provide a simple method for studying plasmonic heating.

Figure 4:
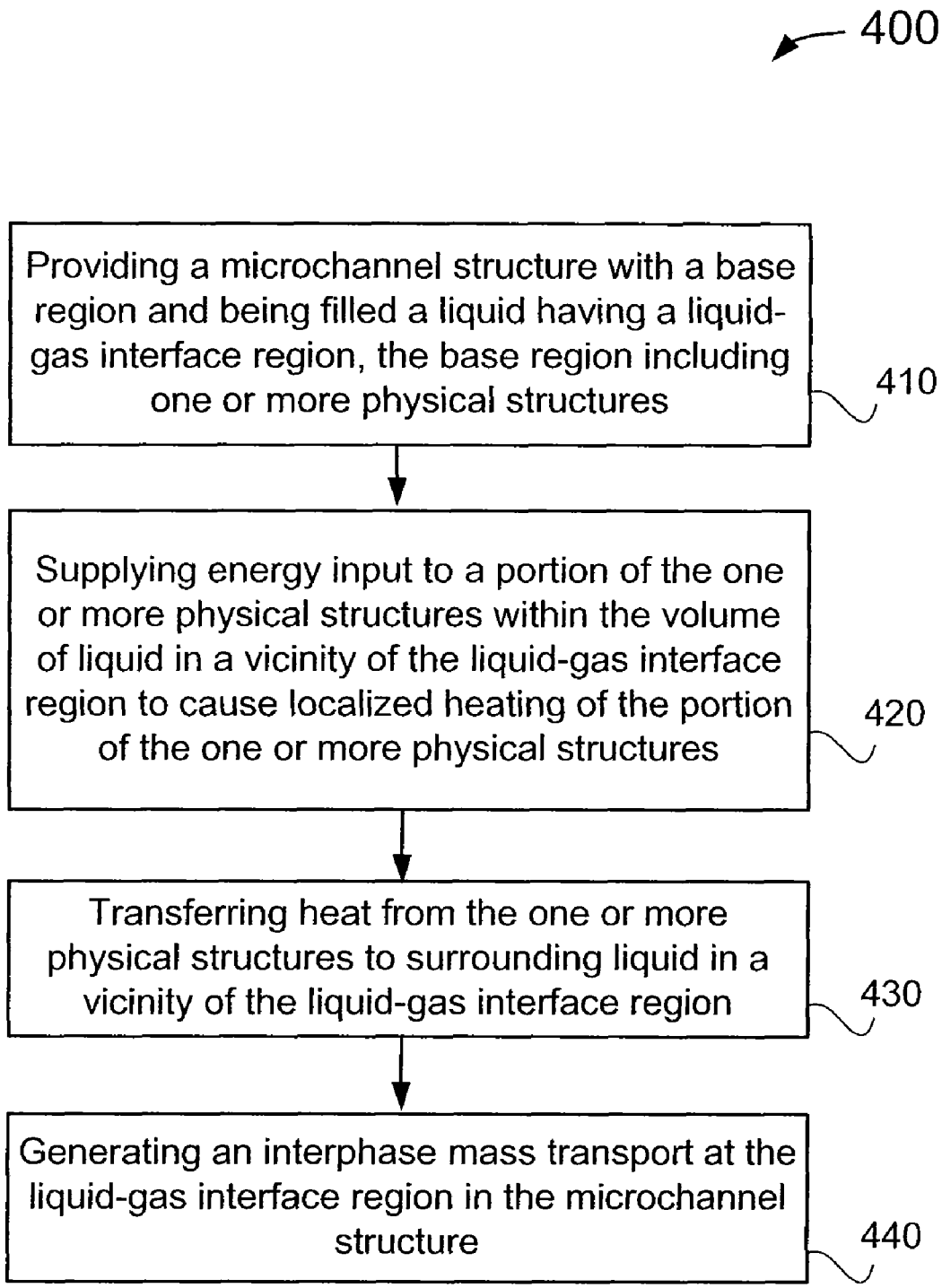
FIG. 4 is a simplified flowchart showing a method of microfluidic control using plasmon assisted heating according to an embodiment of the present invention.

As demonstrated in above examples, we have presented a method of microfluidic control with an all-optical technique using plasmon resonance heating of an array of nanoscale metal structures embedded within the fluid. FIG. 4 is a simplified flowchart summarizing a method of microfluidic control using plasmon assisted heating according to an embodiment of the present invention. This diagram is merely an example, which should not unduly limit the scope of the claims herein. One of ordinary skill in the art would recognize many variations, alternatives, and modifications. As shown, the method 400 includes a process to provide a microchannel structure with a base region (Process 410). The microchannel structure partially is filled with a volume of liquid and a gas at an ambient temperature. The volume of liquid and the gas are separated by a liquid-gas interface region at a first position of the microchannel structure. Additionally, the base region of the microchannel structure includes one or more physical structures. Of course, there can be many variations, alternatives, and modifications. For example, the one or more physical structures can be a nanometer scale patterned metal film. In one embodiment, the nanometer scale metal film can be an array of nanometer particles coated or embedded on the base region. These nanometer scaled physical structures inherently are characterized by a strong absorbance band associated with a plasmon resonance frequency range.

In one example, the microchannel structure or simply fluidic channels can be formed using soft lithography techniques by casting of PDMS (10:1 GE-RTV615 A:B). Replica molds are created through contact lithography of a positive photoresist (SPR 220-7, Michrochem). The fabricated microchannels had widths of 20 μm, 30 μm, 40 μm, and 60 μm, and measured heights 5 μm. The formed PDMS channels are then peeled away from the molds after curing for 30 minutes at 80° C. The PDMS chips are washed in ethanol and their surfaces are cleaned using cellophane tape (Scotch brand). Chips were placed in contact with the prepared substrate bases and examined for blockages, air bubbles, or other imperfections under 100× magnification. Chips with clean, unblocked channels were baked for at least 4 hours at 80° C. to form a strong reversible bond between the PDMS and the substrate base. The formed PDMS microchannels are optical transparent.

Figure 14:
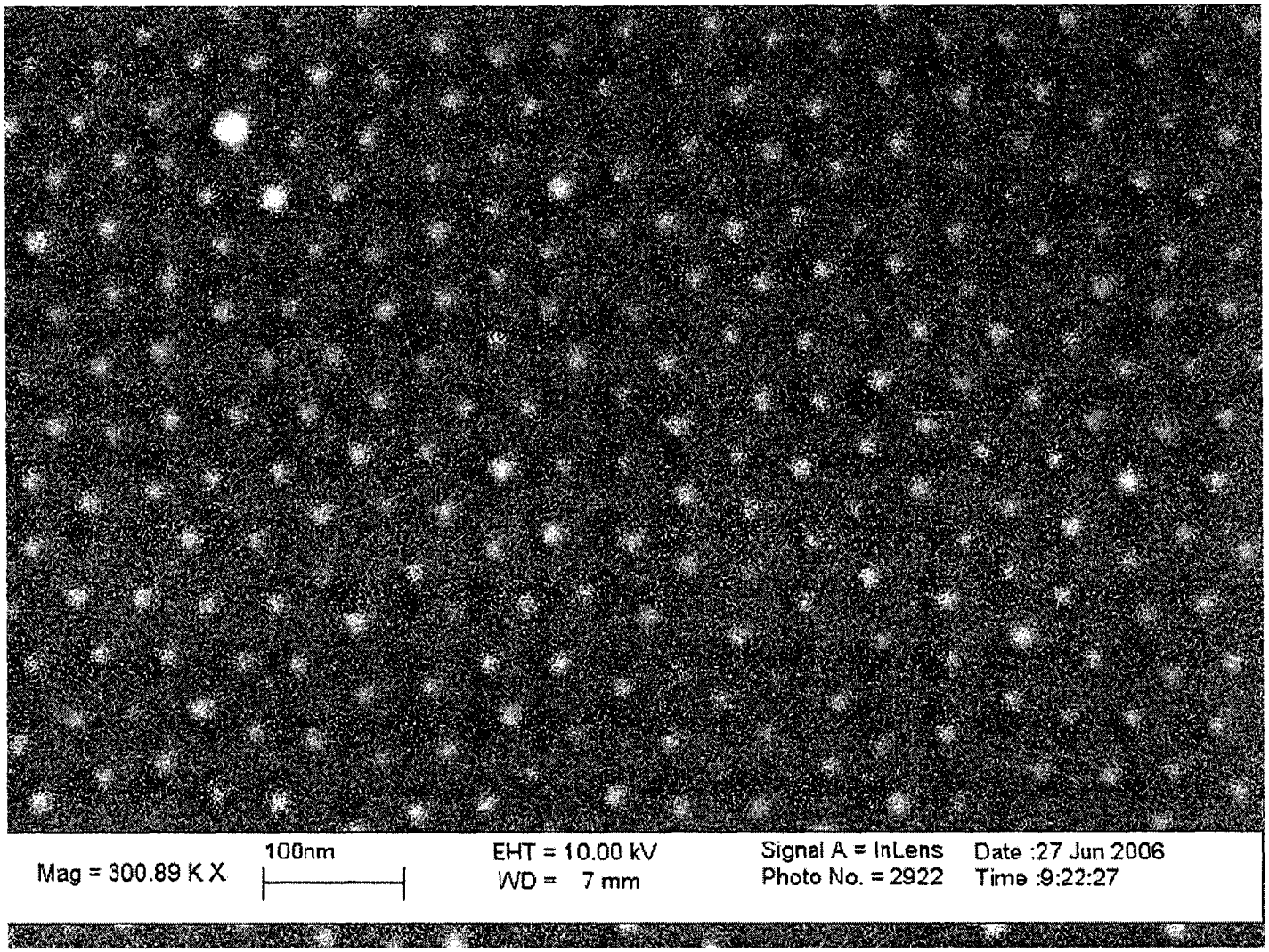
FIG. 14 shows an exemplary scanning electron micrograph of an array of Au nanoparticles on a base according to an embodiment of the present invention.
Figure 16:
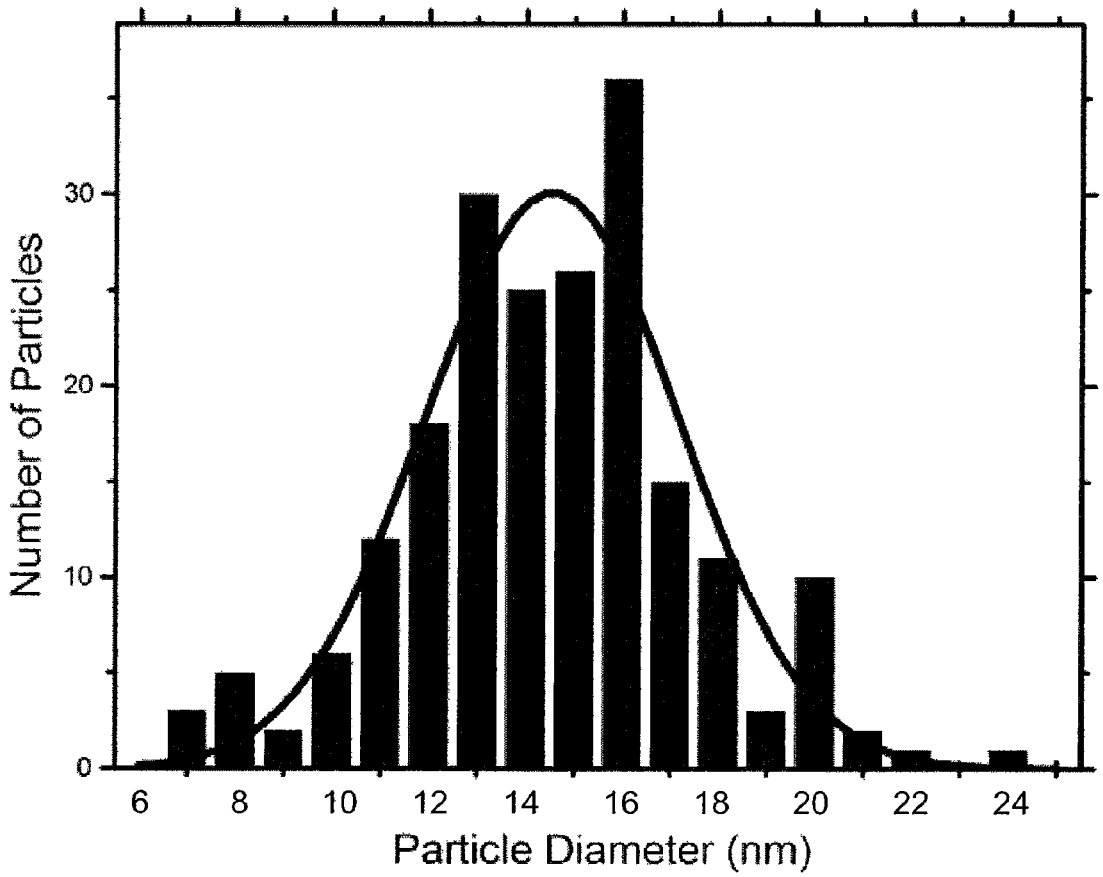
FIG. 16 shows an exemplary size distribution of the array of nanoparticles according to an embodiment of the present invention.

The substrate base or the base region for the PDMS microchannel can be a dielectric material that is also optical transparent. For example, the substrate is a glass slide. In a specific embodiment, the base region is simply a pre-treated glass substrate on which the one or more physical structures characterized in nanometer scale are prefabricated as an quasi-ordered Au nanoparticle array with an average diameter of about 15 nm and an average inter-particle spacing of about 50 nm. The Au nanoparticle array can be fabricated by the block copolymer lithography (BCPL) method. In one example, a mixture of 25.4 mg of the diblock copolymer [polystyrene$_{81,000}$-block-poly(2-vinylpyridine)$_{14,200}$ (Polymer Source, Inc.)] and 5 ml of toluene is stirred in a nitrogen purged and dark environment and stirred overnight, about 8 mg of $HAuCl_4H_2O$ are added, and this solution is stirred for 90 hours. The solution is then spun on to a glass microscope slide and allowed to dry. The substrate is further treated in an oxygen plasma for 10 minutes at 75 W. The substrates are then treated in an adhesion promoting vapor (hexa-dimethyl-siloxane 100% 2 min) to render them more hydrophobic and facilitate bonding with soft-fluidic structures. As an example, FIG. 14 shows an exemplary scanning electron micrograph of an array of Au nanoparticles on a base according to an embodiment of the present invention. As shown, the array of Au nanoparticles are produced on an $SiO_2$ base region by BCPL method. They appear to possess a quasi-ordered pattern with relatively equal size and an average inter-particle spacing of about 50 nm. Correspondingly, the particle size distribution of corresponding array of Au particles is shown as a histogram in FIG. 16. The solid line in the figure gives a Gaussian fit of the particle number histogram. The obtained mean is 14.5 nm that consistent with an average particle size of about 15 nm shown in the SEM image (FIG. 14).

Referring to FIG. 4, the method 400 further includes a process of supplying energy input to a portion of the one or more physical structures within the volume of liquid in a vicinity of the liquid-gas interface region to cause localized heating of the portion of the one or more physical structures (Process 420). In an embodiment, supplying energy input can be provided by illuminating electromagnetic radiation. In particular the electromagnetic radiation is a light beam characterized by a determined frequency within the plasmon resonance frequency range associated with the one or more physical structures on the base region. In one example, the one or more physical structures on the base region is an array of Au nanoparticles that described above. FIG. 15 shows an exemplary absorbance spectrum of such an array of Au nanoparticles according to an embodiment of the present invention. As shown, a strong absorption band is found to be in a range of wavelengths from about 520 nm to 570 nm, peaking at about 535 nm corresponding to a plasmon resonance frequency of about $5.6\times10^{14}$ Hz. This enhanced absorption around 535 nm is resulted from a plasmon resonance excitation of a portion of the array of Au nanoparticles under the illumination of electromagnetic radiation with a determined frequency close to the plasmon resonance frequency range of such array of Au nanoparticles. For example, the electromagnetic radiation is a laser beam in 532 nm wavelength with power of 14 mW and a beam spot diameter of about 10 μm. In one embodiment, the localized heating of the portion of the one or more physical structures can be achieved by using a focused laser beam with a frequency close to a plasmon resonance frequency range to induce a plasmon resonance excitation of the portion of the one or more physical structures. Of course, there can be many variations, alternatives, and modifications. For example, supplying energy input in the Process 420 can also be carried out through local resistive heating, magnetic induction or resonance.

Referring again to FIG. 4, the method 400 also includes a process of transferring heat from the portion of the one or more physical structures to surrounding liquid in the vicinity of the liquid-gas interface region. The one or more physical structures act as a conversion medium for the photothermal heating. In one experiment it is an array of metal nanoparticles embedded on the surface of a microfluidic chip. It has been shown that when the experiment of laser-induced plasmonic heating is performed in vacuum the heat transfer from the nanoparticles to the supporting substrate was minimal so to allow them to retain more of the heat than they would otherwise for a given laser power and the nanoparticles could be heated to high temperatures. However when such an array of nanoparticles are surrounded by a liquid, the heat from the nanoparticles would transfer directly to the liquid allowing for an all-optical method for local fluid heating without the requiring having nanoparticles in solution.

We further examined the plasmonic heating of the fluid using temperature sensitive fluorescence intensity measurements. As was mentioned earlier, the dye solution is temperature sensitive. The Coumarin 4 dye is itself pH sensitive, and the Tris buffer solution has a pH with a well-known temperature dependence. By warming the fluid we decrease the pH causing a decrease in the intensity of the fluorescence, which we calibrated to the temperature. The dye was excited with a 405 nm laser. A bandpass filter inserted before the CCD passed only the fluorescence from the fluid and blocked the both the 405 nm and 532 nm lasers. To prevent the evaporative effects allowed by a bubble, we examined continuous column of fluid without a bubble, i.e., a single surface or liquid-air interface. When the beam was placed in fluid away from the free liquid-air interface, we were not able to measure any significant temperature change to within 2° C., even directly in the beam spot, and when the laser beam was placed close to the free liquid-air interface, the rapid evaporation and condensation caused the free liquid-air interface to wet-forward. These results suggest that when the laser is placed close to free liquid-air interface, a portion of the energy imparted to the fluid by the plasmonic heating goes into latent heat of vaporization.

To estimate the temperature rise of a nanoparticle by laser heating of a nanoparticle by a CW laser we consider a model where the particle temperature is ultimately determined by the incident power density and the heat transfer from the nanoparticles to the substrate. In a specific embodiment, the temperature of a spherical particle due to a power density $I_0$ in the steady state can be shown to be:

$$T_0 = T_\infty + \frac{I_0 K_{abs} r_0}{4k_\infty} \quad (1)$$

where $K_{abs}$ is the efficiency absorption factor, which can be calculated from Mie scattering theory, for a particle of radius $r_0$ and $k_\infty$ is the coefficient of thermal conductivity of the surrounding medium at the macroscopic equilibrium temperature $T_\infty$. Due to nanoscale effects that limit the heat transfer from a nanoparticle to a solid, in one embodiment, most of the heat generated by the plasmon heating in the nanoparticles is transferred to the surrounding fluid. For example, we set $k_\infty$ to be 0.65, and we use a value $K_{abs}$=1.5. From Equation 1, the rise in the temperature of nanoparticles is less than 2° C. Of course, these numbers are all approximate and are presented to demonstrate semi-quantitatively the heat transfer results are feasible. There can be many variations, alternatives, and modifications.

Referring back to FIG. 4, the method 400 includes a process of generating an interphase mass transport at the liquid-gas interface region in the microchannel structure (Process 440). When the laser is focused at the base of channel near the liquid-gas interface, rapid evaporation from the free liquid-gas interface and re-condensation in the channel are observed. The nucleation of small condensed drops near the contact line causes the free liquid-gas interface to "wet forward" slightly. In addition, as shown in last paragraph, the temperature of bulk liquid is found to be substantially remaining at an ambient state except a less than 2° C. rise around the nanoparticles during the whole process. In certain embodiments, the method 400 has been demonstrated to be applicable in several experiments shown in FIGS. 3A-3G.

In another specific embodiment, the present invention introduces a process of captive gas bubble into a microchannel. Unlike a vapor bubble, a gas bubble bounded by the walls of the microchannel provides two stable phase boundaries without the need for heat input to form and maintain the phase separation. At equilibrium there is no net mass-transfer between the liquid and vapor phases. However by locally heating one interface, mass-transfer can occur in the same manner as a vapor bubble but by evaporation. In one embodiment, only a slight temperature difference between the free surfaces in such a bubble is necessary to produce sufficient mass-transfer for microfluidic pumping. In another embodiment, this mechanism allows for bio-compatible intra-channel distillation and the collection of suspended solids in a mixture. This process can be referred as bubble assisted interphase mass-transfer (BAIM) through this specification.

According to certain embodiments of the present invention, Localized heating is key to this process. In one specific embodiment, we present a microfluidic system where heating is provided by a stationary, low power laser. Evaporation, unlike boiling, is a surface phenomena, and microfluidics is naturally suited for accessing the liquid in the immediate vicinity of a free surface or liquid-vapor interface of a bubble. In this experiment, energy is added near the liquid-vapor interface, some of which goes directly into the latent heat of vaporization. The process is not exclusive to photothermal heating, for example, it may be replaced by resistive heating or magnetic resonance heating, however, as will be discussed later there are certain advantages of this heating technique.

Figure 5A:
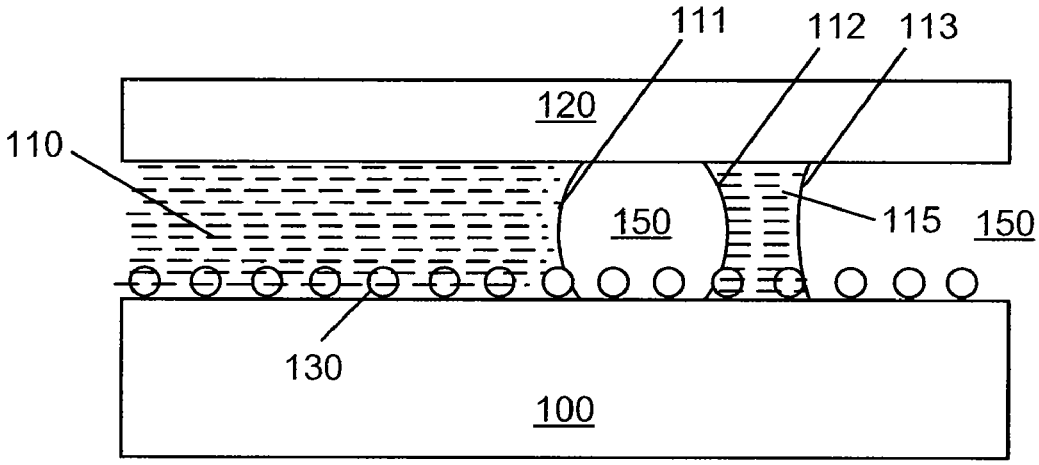
FIGS. 5A-5B are schematic diagrams showing a microchannel assembly partially filled with a liquid and an entrapped gas bubble near a liquid-gas interface region and a mass transport across the gas bubble induced by an illuminated laser beam according to an embodiment of the present invention.
Figure 5B:
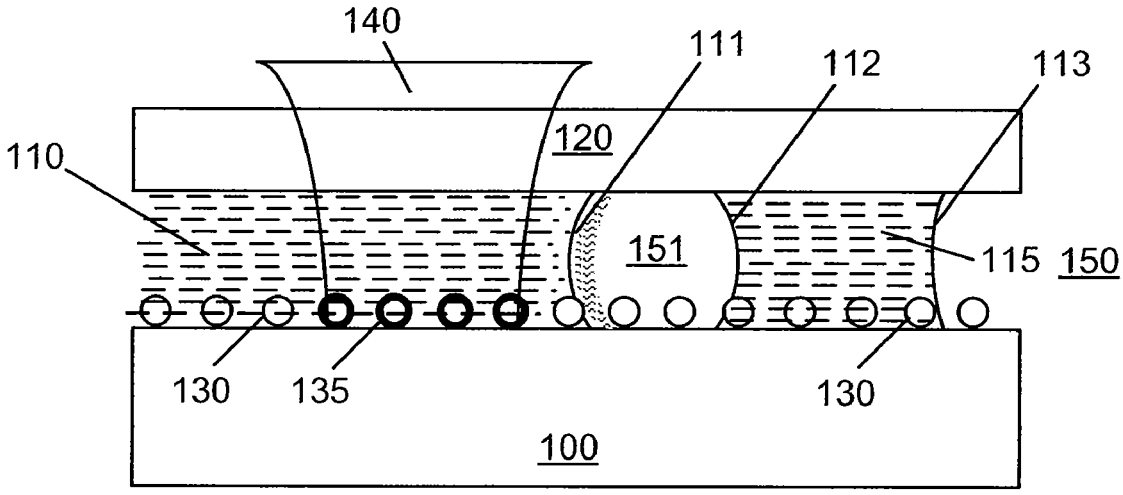

In this experiment, the channels are cast in poly-dimethylsiloxane (PDMS) and sealed to a glass substrate coated with an array of Au nanoparticles, which is created by block-copolymer lithography. The average particle diameter is 14.5 nm with an average spacing of 46 nm. The channels range in width from 20 to 40 μm and the heights are all 5 μm. Unless noted otherwise, de-ionized water is used exclusively as the working fluid. A 532 nm laser, which is close to plasmon resonant frequency of the gold nanoparticle arrays, is focused through the glass substrate onto the gold nanoparticle layer. The power at the sample is 14 mW and the diameter of the beam spot is about 10 μm. A schematic side view of the microchannel system (simplified as a channel 120 over a base 100) is illustrated in FIG. 5, which is partially filled with a liquid 110 and an entrapped gas bubble 150 near a liquid-gas interface region 111 and a mass transport across the gas bubble 150 induced by an illuminated laser beam 140 according to an embodiment of the present invention. This diagram is merely an example, which should not unduly limit the scope of the claims herein. One of ordinary skill in the art would recognize many variations, alternatives, and modifications. As shown, a quasi-ordered array of nanoparticles 130 is incorporated in the base 100 of a standard microfluidic channel 120, and a gas bubble 150 is formed in the channel. A laser 140 near the resonant frequency is focused either through the channel 120 or the base on a portion of nanoparticles 135, causing them to be heated through a plasmon resonance excitation. The heat from the portion of nanoparticles 135 is transferred to the surrounding fluid causing evaporation of liquid from a surface nearby, which is substantially the original liquid-gas interface region 111, of the bubble 150. The vapor enters the gas bubble to form a gas_plus_vapor bubble 151. The vapor is subsequently condensed on the far surface 112 of the bubble 151. In one embodiment, the net effect of this evaporation and recondensation leads to an increase in the volume of the liquid column 115 to the right of the bubble 151 and corresponding movement of the position of the far right interface 113 of the liquid column 115 to the farther right.

Figure 6:
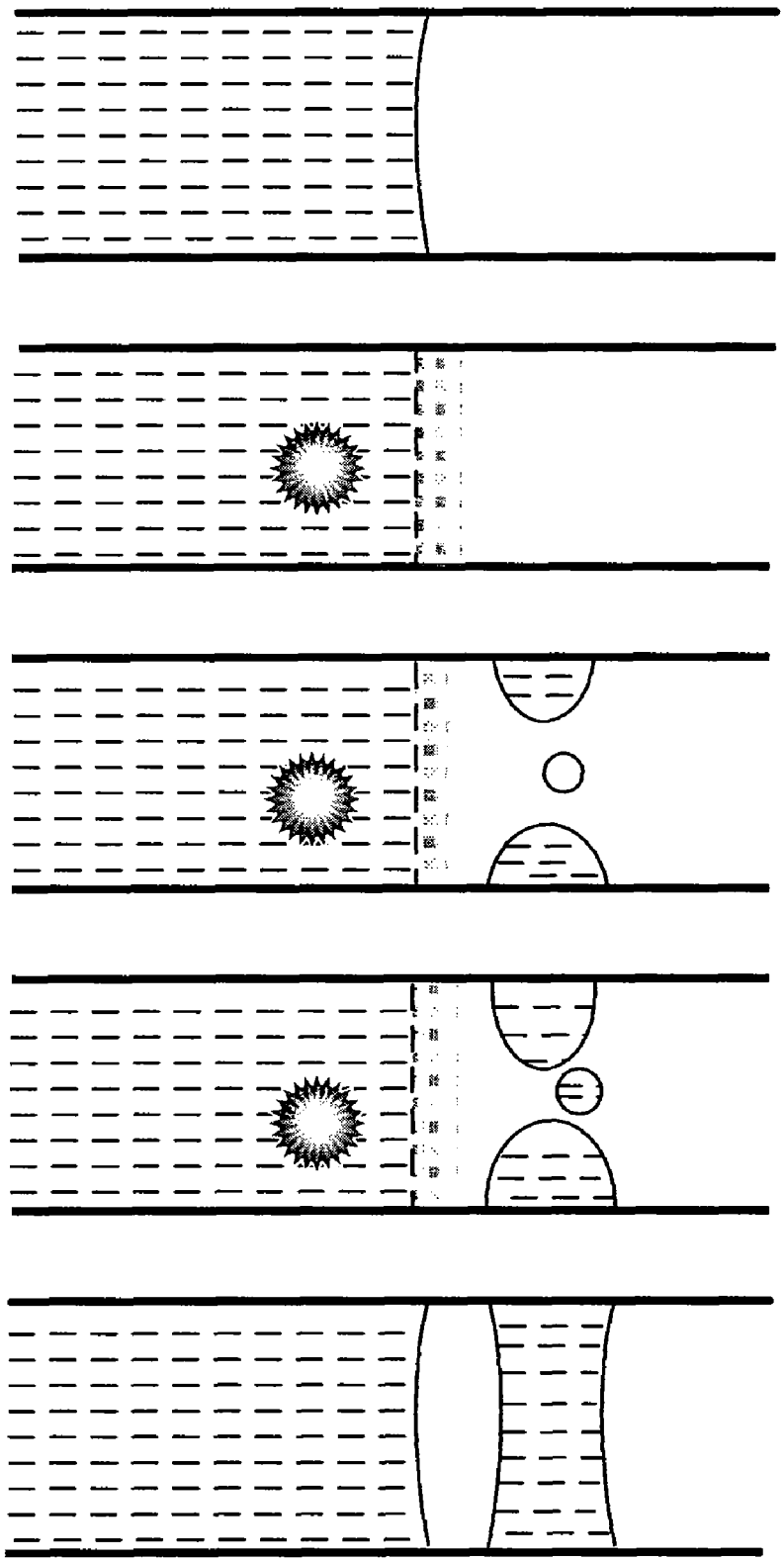
FIG. 6 is a simplified diagram showing a series of processes for entrapping a gas bubble in a channel according to an embodiment of the present invention.

Gas bubbles can be formed in the liquid by trapping gas in the partially filled channel. In one embodiment, we placed the laser spot near the free surface of the liquid, causing local accelerated evaporation of the free surface and vapor recondenses on the channel walls at about 10-30 μm away from the surface. In one embodiment, the vapor selectively recondenses in the areas where there is already a nucleated water droplet. The droplets on the wall tend to grew together to form a continuous liquid plug, trapping a gas bubble with a width of 10-20 μm between the original free liquid-gas interface and the plug. FIG. 6 is a simplified diagram showing a series of processes for entrapping a gas bubble in a channel according to an embodiment of the present invention. This diagram is merely an example, which should not unduly limit the scope of the claims herein. One of ordinary skill in the art would recognize many variations, alternatives, and modifications. It should be noted that the evaporative mass-transfer process we have described does not require gas bubbles to be formed in this manner. In one example, gas bubbles could be injected into the channel or a hydrophobic gap in the channel could be used. In another example, the gas in the bubble or the gas to the right of the liquid plug is gas plus liquid vapor or simply ambient air plus water vapor.

Figure 7A:
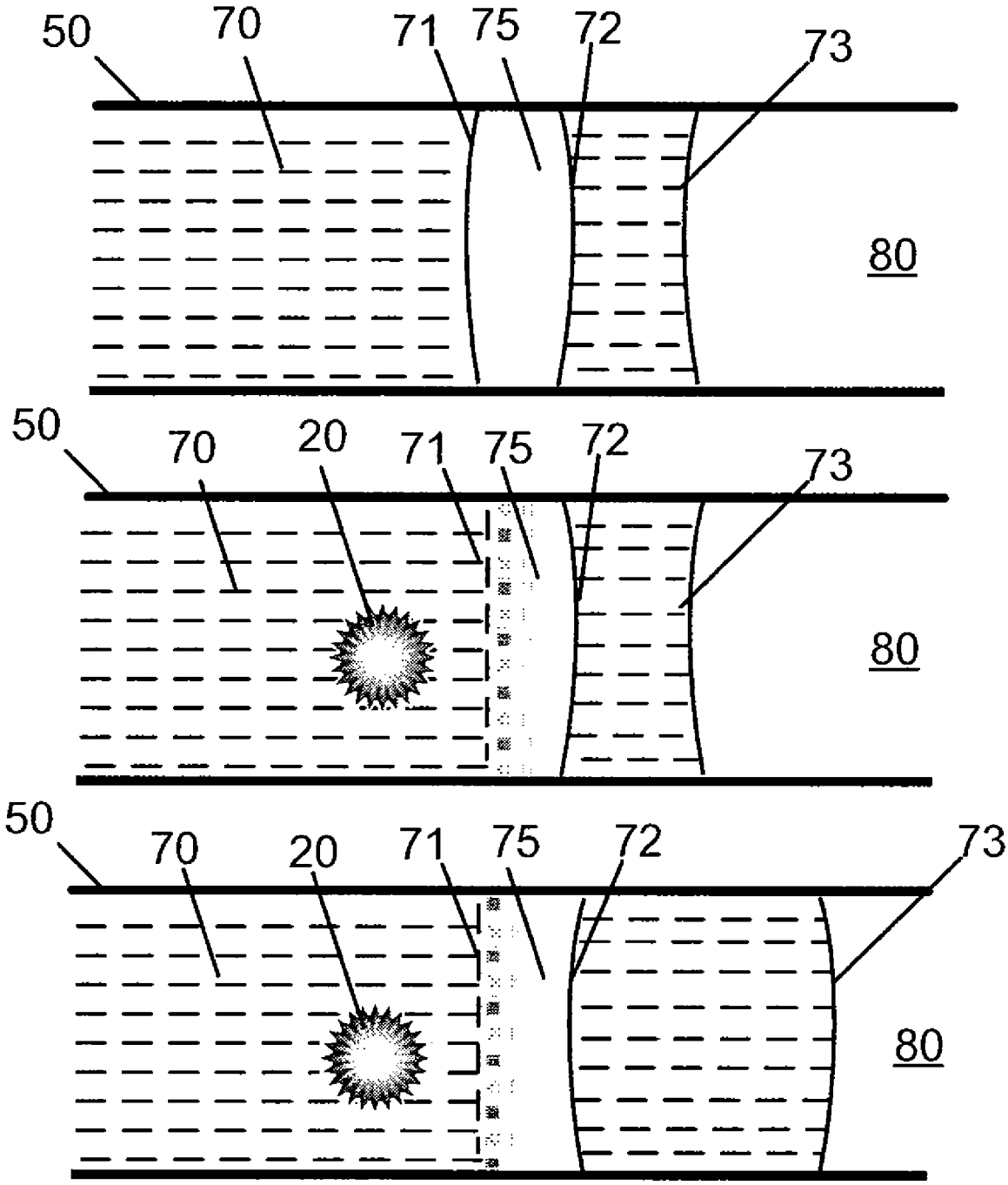
FIG. 7A is a schematic side view of an operation of bubble assisted interphase mass transport in microfluidic channel according to an embodiment of the present invention.

FIG. 7A is a schematic side view of an operation of bubble assisted interphase mass transport in microfluidic channel according to an embodiment of the present invention. This diagram is merely an example, which should not unduly limit the scope of the claims herein. One of ordinary skill in the art would recognize many variations, alternatives, and modifications. As shown, an air bubble (75) is formed in the fluid between a first volume of liquid (70) and a second volume of liquid (90) (which has a free interface with air 80), across a lateral dimension of the channel (50). A laser beam spot (20) is focused near the edge of the bubble (a first liquid-air interface 71 at the left), and fluid (70) near the laser spot is vaporized into the bubble (75) and recondenses on the opposite side (i.e., a second liquid-air interface 72 at the right). The mass transfer though the bubble (75) results in a continuous mass flow along the channel (50) from the first liquid-air interface (71) to the second liquid-air interface (72) which flows into the second volume of liquid (90) effectively displaces a third liquid-air interface (73) at the far right forward.

Figure 7B:
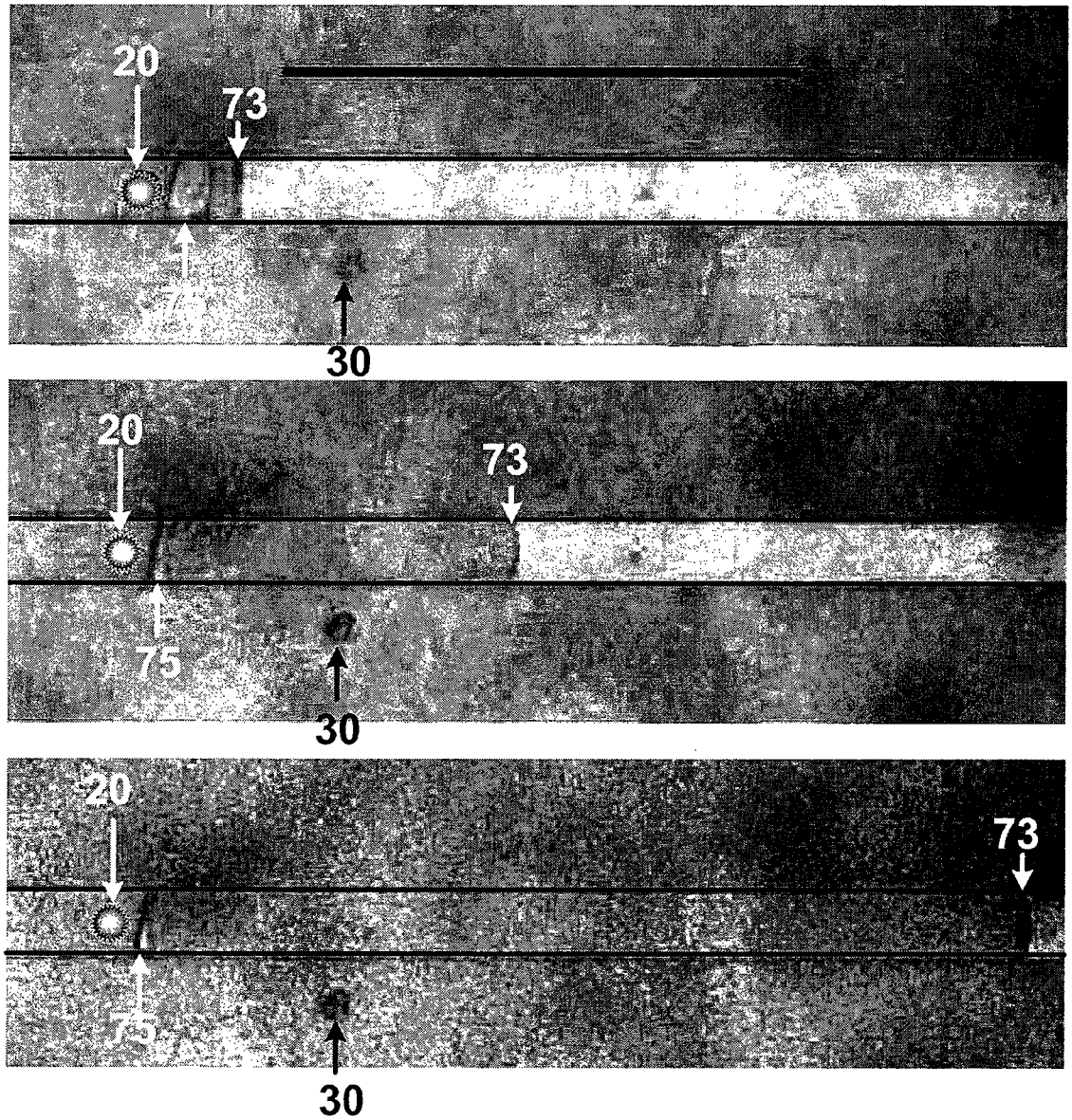
FIG. 7B is an exemplary series of images showing a continuous mass flow through the bubble according to an embodiment of the present invention.

FIG. 7B is an exemplary series of images showing a continuous mass flow through an air bubble according to an embodiment of the present invention. This diagram is merely an example, which should not unduly limit the scope of the claims herein. One of ordinary skill in the art would recognize many variations, alternatives, and modifications. As shown, images of this process are taken during vapor pumping in a 40 μm channel (a scale bar of 200 μm is shown in top frame). In one embodiment, placing the laser spot (20) several microns behind the captive air bubble (75) allows steady mass-transfer or induce a pumping across the bubble (75) from the first liquid-air interface to the second liquid-air interface, increasing the volume of fluid on the opposite side and pushing the free surface front (73) to farther right. A marker (30) is indicated by an arrow for position reference. This 'pumping' action can be continued indefinitely, as liquid from the supply reservoir will replace the vapor that passes through the bubble. In one example, we do not observe the pumping action stall even when the column of the pumped fluid (to the right in the channel) was several millimeters in length. In another embodiment, the air bubble (75) remains substantially stationary throughout this process.

Figure 8:
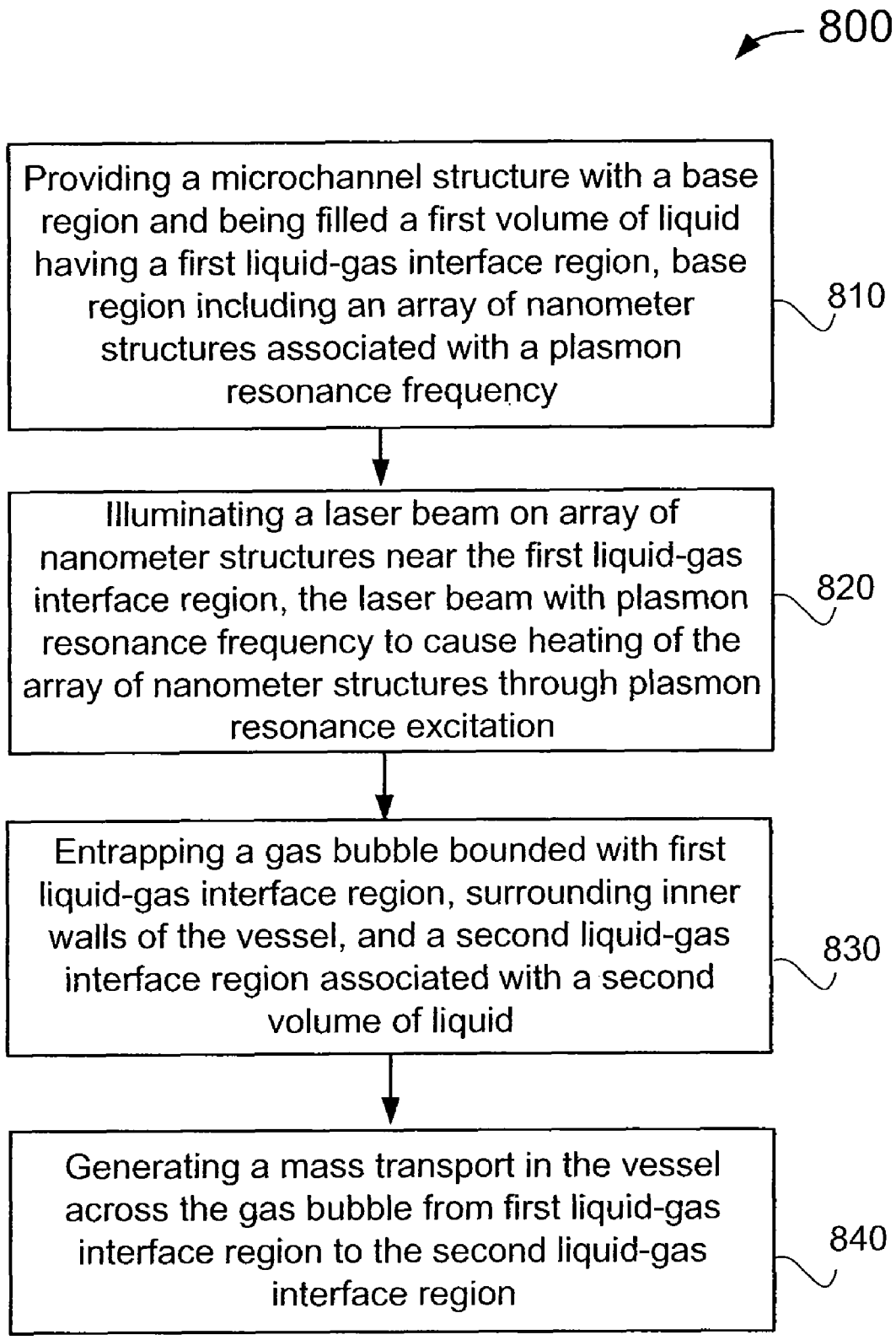
FIG. 8 is a simplified flowchart showing a method of plasmon resonance assisted microfluidic pumping according to an embodiment of the present invention.

FIG. 8 is a simplified flowchart that summarizes a method of plasmon resonance assisted microfluidic pumping according to embodiments of the present invention. As shown, the present invention provides a method 800 including a process (810) of providing a vessel partially filled with a first volume of liquid. The first volume of liquid is separated from a gas by a first liquid-gas interface region. The vessel characterized in micrometer scale includes a base region, a width, and a height. In a specific embodiment, the base region includes an array of nanometer structures associated with a plasmon resonance frequency range. The method 800 further includes a process (820) of illuminating a laser beam on a portion of the array of nanometer structures within the first volume of liquid substantially near the first liquid-gas interface region. The laser beam is characterized by a power level and a determined frequency within the plasmon resonance frequency range to cause plasmon resonance excitation and thereby heating of the portion of the array of nanometer structures. Additionally, the method 800 includes a process (830) of entrapping a gas bubble in the vessel by forming a second volume of liquid at a distance in front of the first liquid-gas interface region through evaporation and recondensation during an energy transfer from the laser beam to liquid around the array of nanometer structures facilitated by the plasmon resonance excitation. The entrapped gas bubble being bounded by the first liquid-gas interface region, surrounding inner walls of the vessel, and a second liquid-gas interface region associated with the second volume of liquid. Furthermore, the method 800 includes a process (840) of generating a mass transport in the vessel across the gas bubble from first liquid-gas interface region to the second liquid-gas interface region. In certain embodiments, the process 840 further includes a step of continuously illuminating the laser beam on the portion of the array of nanometer structures within the first volume of liquid near the first liquid-gas interface region; a step of transforming heat at least partially to a latent heat of evaporation of a portion of the first volume of liquid at the first liquid-gas interface region while keeping temperature increase of the portion of the first volume of liquid less than 2 degrees of Centigrade; a step of converting the portion of the first volume of liquid to a vapor into the gas bubble; and a step of thereafter condensing the vapor at the second liquid-gas interface region. In one embodiment, the laser beam used in the method is substantially stationary relative to the vessel and the first liquid-gas interface region. In another embodiment, the gas bubble keeps a substantially stable size defined by a spacing between the first liquid-gas interface region and the second liquid-gas interface region during the mass transport in the vessel after an earlier shrinkage within a few seconds of illuminating the laser beam. In yet another embodiment, the stable size of the gas bubble corresponds to a steady state pumping rate for the mass transport from the first volume of liquid to the second volume of liquid. In still yet another embodiment, the steady state pumping rate is substantially constant with time and linear with the power level of laser beam. According to certain embodiments, the method 800 has been demonstrated to be applicable in all experiments shown in FIGS. 6 and 7B.

In certain experiments we examine the mass-transfer rates of the liquid by digitizing images of the channel using a color video camera. In particular, the position of the 'free-surface', i.e. the leading liquid-gas interface of the fluid column, for example the one located far right of the bubble in FIG. 7B, can be determined using an edge detection algorithm. Plots of the measured free-surface position against time are fit using linear regression to determine the pumping speed for both the full power and reduced power regions.

Figure 9A:
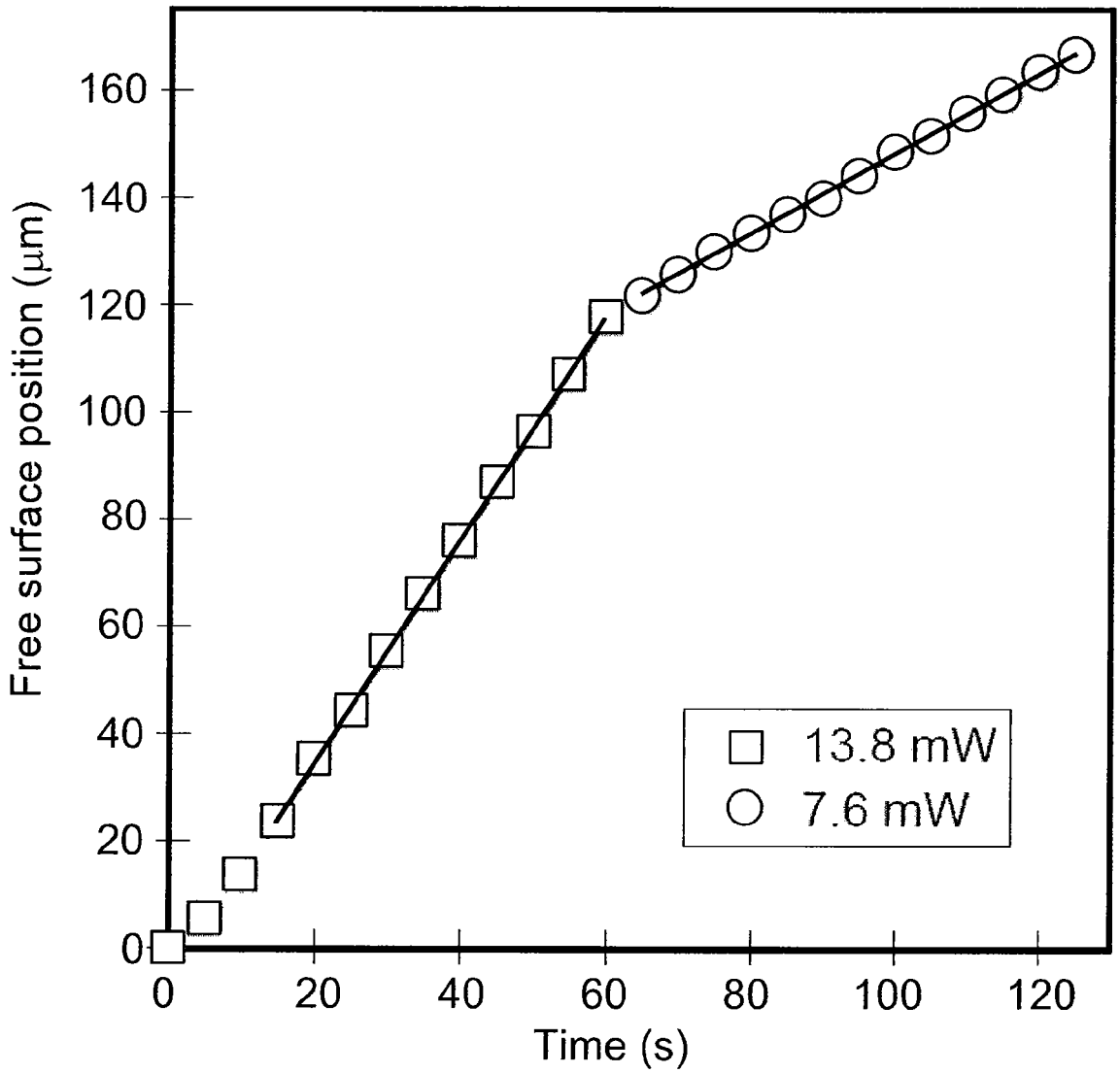
FIG. 9A is a plot of the position of the liquid-air interface during microfluidic pumping according to an embodiment of the present invention.

In one embodiment, the steady state rate of bubble assisted interphase mass-transfer (BAIM) for a given laser power is constant with time. FIG. 9A is a plot of the position of the liquid-air interface during microfluidic pumping according to an embodiment of the present invention. This diagram is merely an example, which should not unduly limit the scope of the claims herein. One of ordinary skill in the art would recognize many variations, alternatives, and modifications. As shown, a plot of the position of the lead liquid-air interface of the vapor pumped liquid in a 30 μm channel is given as a function of time. The linear fits correspond to a flow rate or pumping rate. At t=0 s, the laser is turned on, and after a few seconds, a constant pumping rate of 2.96 μm/s is observed. At t=60 s, the total laser power is reduced by a factor of 0.55 by insertion of a neutral density filter (measured optical density=0.26). The measurements of the pumping rate are carried out by digitizing images of the channel using a color CCD. Correspondingly, the pumping rate is reduced to 1.55 μm/s, and as can be seen in FIG. 9A, the rate remains constant with time. In one example, during the first few seconds after the laser is turned on, the pumping rate increases. This is due to a shrinkage of the original air bubble as the vapor pump begins operation, presumably due to an increase in pressure as evidenced by a change in the curvature of the bubble. In another example, after fifteen to twenty seconds, the bubble stabilizes to a size of less than ten microns wide, which is maintained as long as the pump operated. The first three data points were omitted from the regression algorithm in order to remove the initial transients and compare steady state flow rates at different power levels.

A summary of the values of the mean free surface velocity $\bar{v}$, the maximum velocity, $v_{max}$, and the average mass flow rate $\bar{J}$, for 20 μm, 30 μm, and 40 μm channels, as measured during pumping, is listed in Table I. The mass flow rate J along the channel is

TABLE I

| Channel width (μm) | $\bar{v}$ (μm/s) | $\sigma(\bar{v})$ (μm/s) | $v_{max}$ (μm/s) | J ($\times 10^{-13}$ kg/s) |
|---|---|---|---|---|
| 20 | 3.32 | 1.46 | 5.11 | 3.3 |
| 30 | 1.97 | 0.53 | 2.73 | 3.0 |
| 40 | 2.76 | 2.14 | 3.45 | 5.5 |

$J=\rho v A$, where ρ is the density of water, v is the measured velocity of the free surface and A is the cross sectional area of the channel. We expect higher values of $\bar{v}$ for smaller channels and similar values of $\bar{J}$ for all widths, while the 40 μm channel do not follow this trend. Although in this case we also observed steady pumping rates for each of these trials, there is a large value in the standard deviation $\sigma(\bar{v})$ of the mean free-surface velocity, and we attribute this in part to the uncertainty in the position between the laser spot and the free surface between the trials.

Figure 9B:
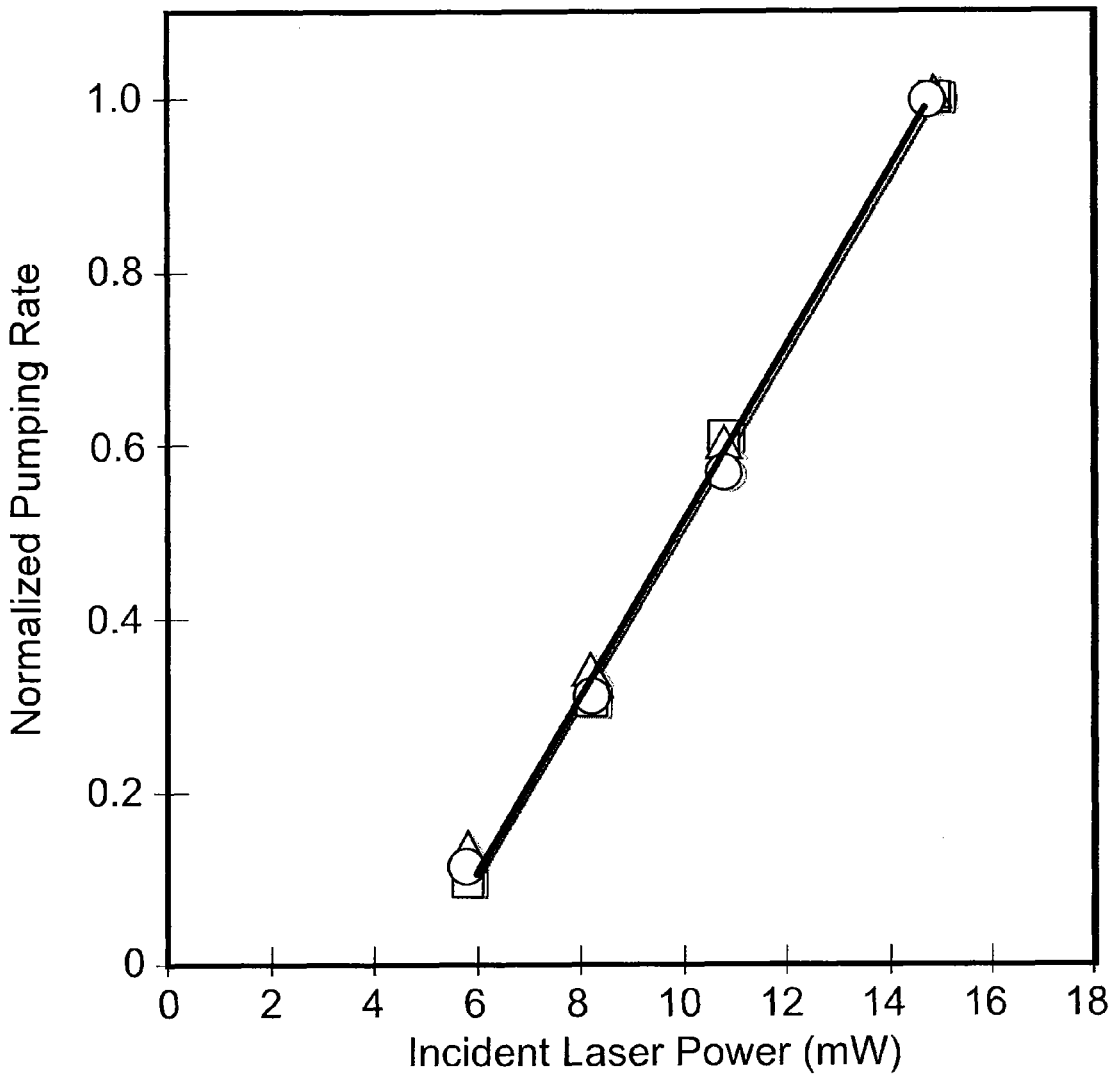
FIG. 9B is a plot of pumping rate of bubble assisted interphase mass-transfer as a function of laser power according to an embodiment of the present invention.

In another specific embodiment, the pumping rate monotonically increases with laser power. FIG. 9B is a plot of pumping rate of bubble assisted interphase mass-transfer as a function of laser power according to an embodiment of the present invention. This diagram is merely an example, which should not unduly limit the scope of the claims herein. One of ordinary skill in the art would recognize many variations, alternatives, and modifications. As shown, the normalized pumping rates for three trials in a 30 μm channel as the laser power decreases with time. During pumping action, the laser power is reduced from the initial value at 30, 60, and 90 s by factors of 0.79, 0.63, and 0.50, respectively. At these times, there are corresponding decreases in the pumping rates. As discussed above, the values in FIG. 9B have been normalized to the average pumping rate at the initial laser power for each trial to minimize the effect of the uncertainty of the position of the laser relative to the free surface.

Figure 9C:
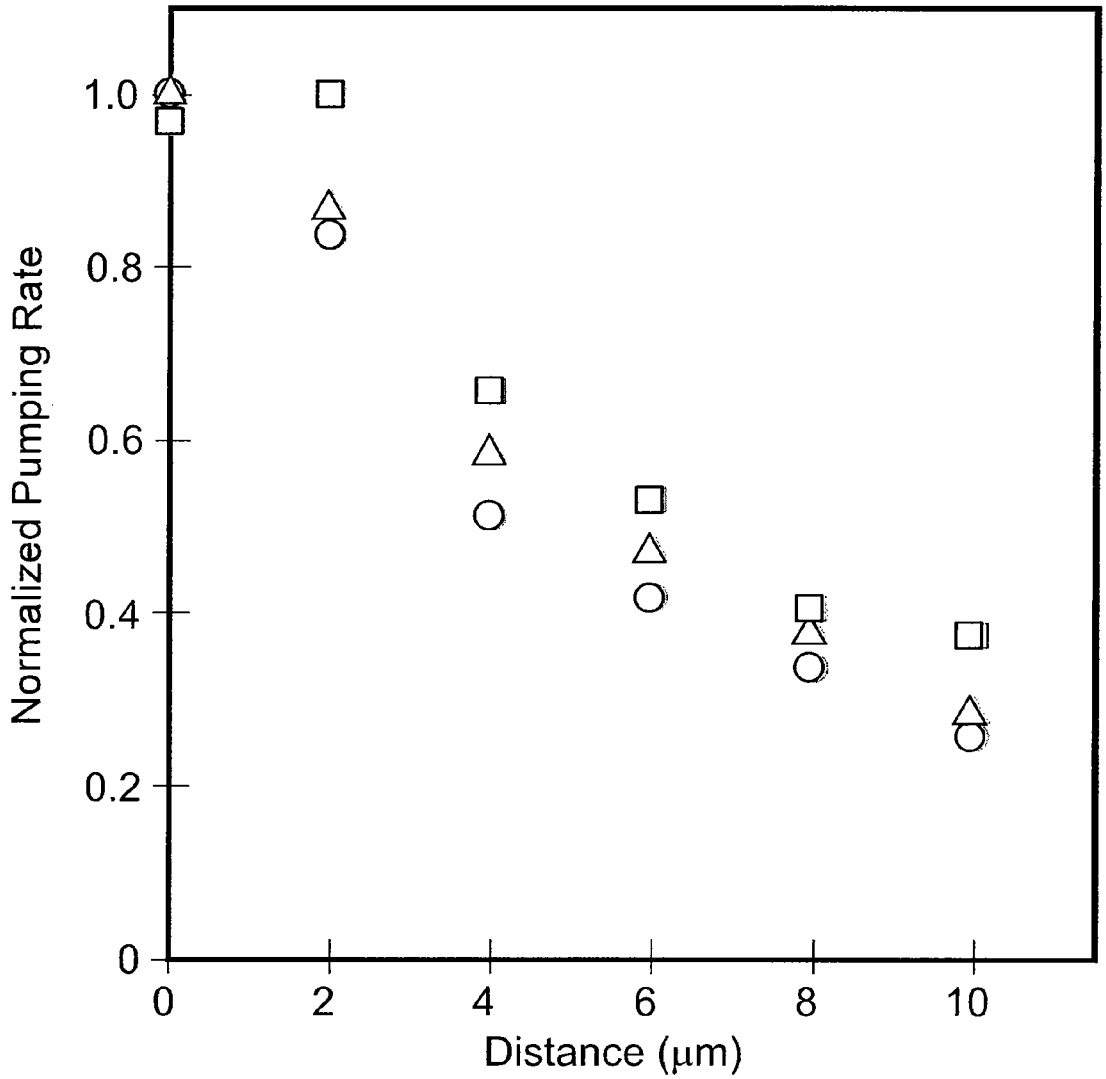
FIG. 9C is a plot of pumping rate of bubble assisted interphase mass-transfer as a function of the position of applied laser spot according to an embodiment of the present invention.

In yet another specific embodiment, the pumping rate decreases with increasing distance between the position of the laser spot and the edge of the gas bubble. FIG. 9C is a plot of pumping rate of bubble assisted interphase mass-transfer (BAIM) as a function of the position of applied laser spot according to an embodiment of the present invention. This diagram is merely an example, which should not unduly limit the scope of the claims herein. One of ordinary skill in the art would recognize many variations, alternatives, and modifications. As Shown, normalized BAIM pumping rates are plotted against the relative laser position for three separate trials in a 30 μm channel. During pumping, the laser was translated away from the gas bubble by a 2 μm increment, held stationary for 10 s, and then this sequence was repeated. Since the absolute position of initial spot with respect to the edge of the bubble is not necessarily the same for each trial, the flow rate for each trial has been normalized to the corresponding initial laser position. Beyond a distance of 10 μm from the initial position, the pumping rates were too slow to be accurately measured. The initial laser spot was kept far enough behind the liquid-air interface to avoid disturbing it. This minimal distance varied slightly for each trial, but we found that a distance of at least 5 μm was sufficient to avoid condensation of vapor inside the air bubble, which could divide the air bubble into two parts.

Figure 10:
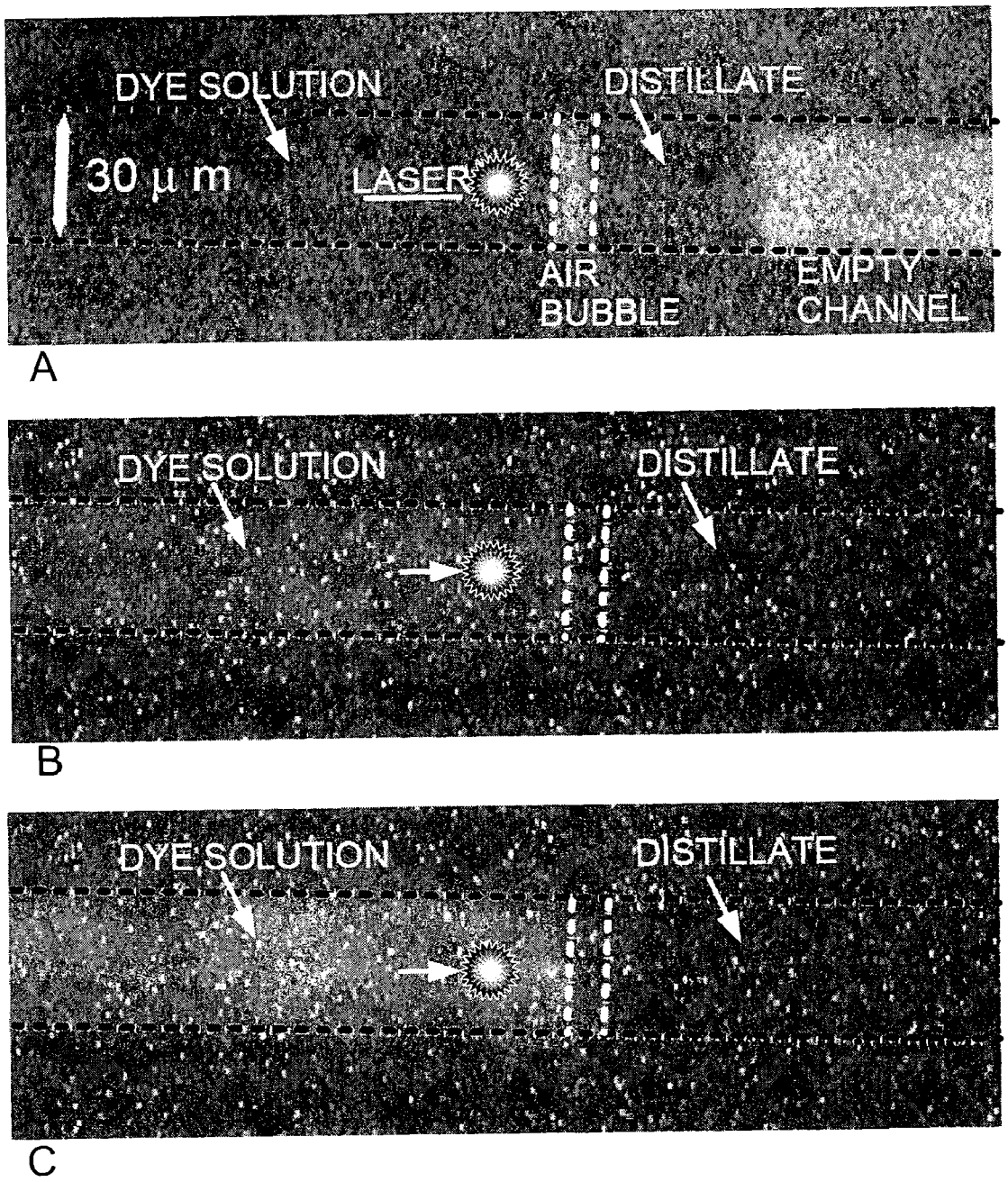
FIGS. 10A-10C show an experimental example of bubble distillation in microfluidic system according to an embodiment of the present invention.
FIG. 10D shows a plot of fluorescence intensity versus time for illustrating bubble distillation in microfluidic system according to an embodiment of the present invention.

In an alternative embodiment, the evaporative mass transfer through the bubble can also serve as method for distillation in microfluidic system. Distillation is an important and widely used application of interphase mass-transfer, but its use in microfluidics, especially with biological systems, is limited by the association with the relatively high temperatures used to create the vapor phase. Certain embodiments of the present invention provide a method for ambient temperature distillation in microfluidic system. FIGS. 10A-10C show an experimental example of bubble distillation in microfluidic system according to an embodiment of the present invention. These diagrams are merely examples, which should not unduly limit the scope of the claims herein. One of ordinary skill in the art would recognize many variations, alternatives, and modifications. As shown, a working liquid solution of ethanol and Coumarin 4 buffered with HCl and tris (hydroxymethyl) aminomethane (Tris buffer) is added to a 30 μm channel. The dye solution is excited from the bottom of the sample with a 405 nm dye laser. Shown in FIG. 10A is white light image of the channel with the working liquid solution (located on the left), and FIG. 10B is a fluorescent image of the same region at initial stage of distillation. As a 532 nm laser drives the vapor transport across the bubble (marked by two white dashed lines), the fluorescence intensity increased with time on laser side (the area indicated by DYE SOLUTION arrow is visibly brighter), and we did not observe any fluorescence on the opposite side of the bubble (indicated by DISTILLATE arrow), as shown in FIG. 10C after 45 s of laser induced evaporation. This demonstrate that fractional distillation can be realized on the opposite side of the bubble, where there should be substantially free of dye molecules.

Figure 10D:
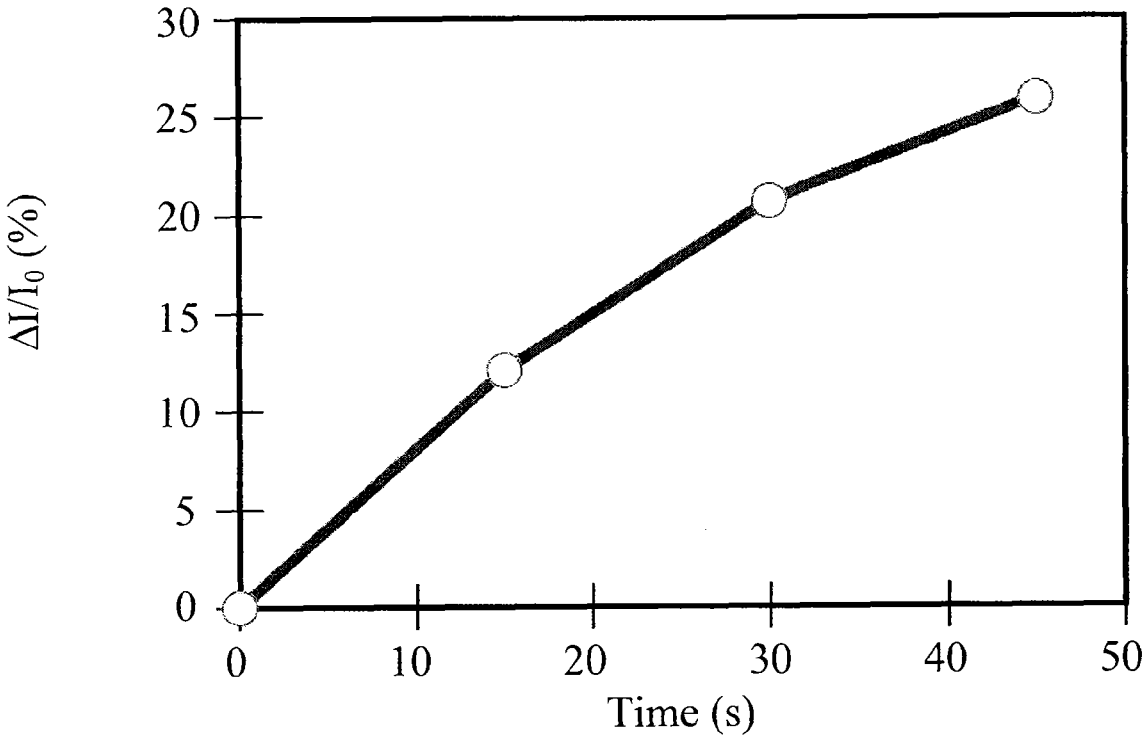
Figure 11:
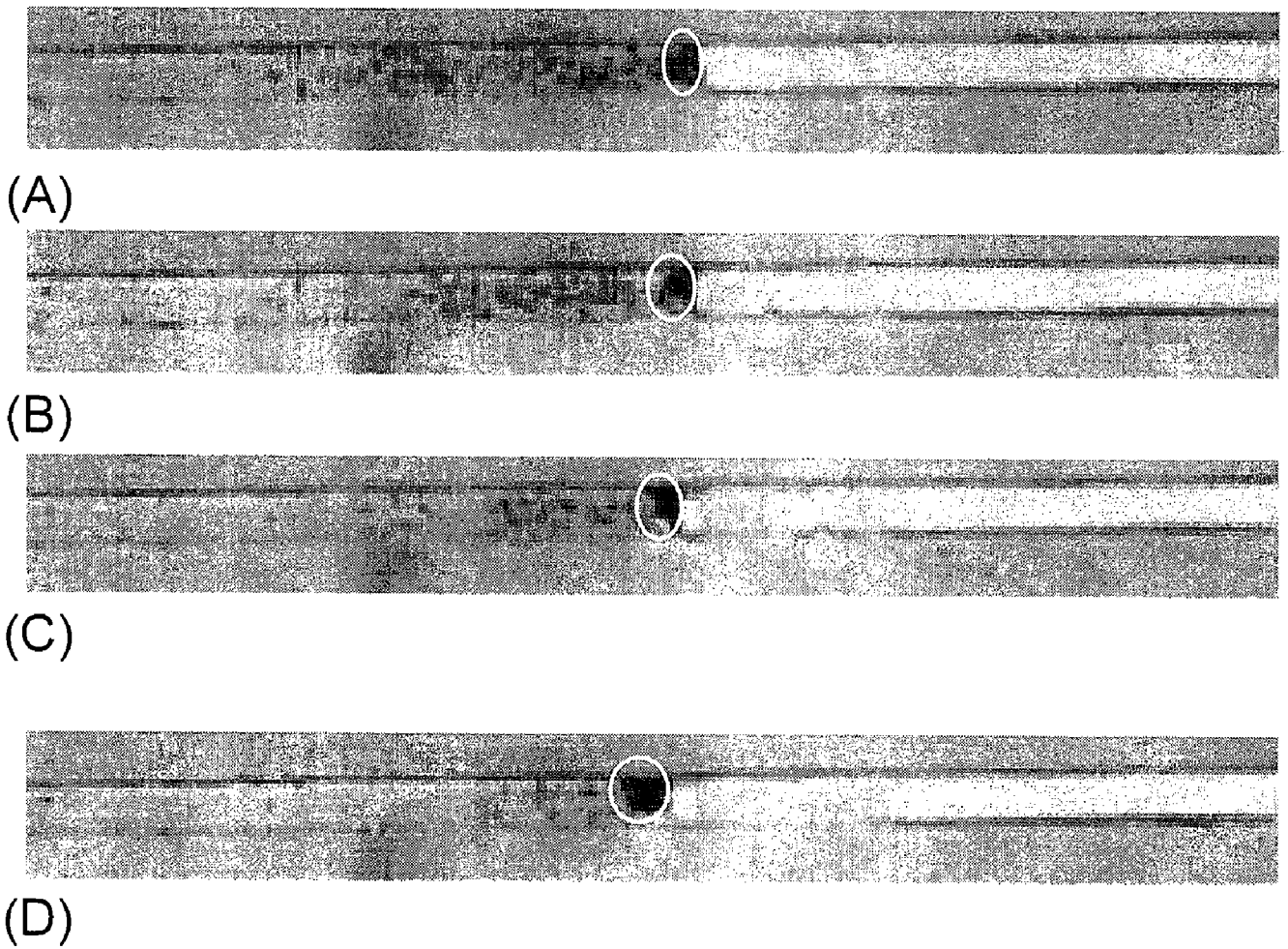
FIGS. 11A-11D show an experimental example of concentration of a liquid mixture according to an embodiment of the present invention.

FIG. 10D shows a plot of fluorescence intensity versus time for illustrating bubble distillation in microfluidic system according to an embodiment of the present invention. This diagram is merely an example, which should not unduly limit the scope of the claims herein. One of ordinary skill in the art would recognize many variations, alternatives, and modifications. As shown, $\Delta I/I_0$ with time during distillation showing an increase in intensity by 25% after 45 s of pumping. Of the components in the solution, the dye molecule has the highest molecular weight and we can assume that it is the least volatile of all the components. As the ethanol evaporates, the dye concentration increases. The HCl will also evaporate and there will be an increase in the local pH of the solution, which will also cause an increase in the intensity. As will be discussed later, we note that the fluorescence intensity of this mixture decreases with increasing temperature. Although the exact composition of the distillate is not known, it can be clearly seen that very little if any of the dye molecule is present. The embodiment demonstrated above provides an all-optical method for intra-channel fractional distillation. In particular, certain embodiments of the present invention offers advantage of not performing at high temperature in this microchannel distillation, compared to conventional approaches using a resistive heater creating the saturated vapor and a carrier gas for vapor transport.

In yet another alternative embodiment, bubble assisted interphase mass-transfer (BAIM) induced by Plasmon resonance excitation using a laser can be applied to concentrate insoluble (suspended) components in liquid mixture, in particular for sample concentration. Conventional methods for sample-concentration include using membranes and electrokinetic trapping. Here we show that embodiments of the BAIM method is applicable to concentration over a large range of molecule or particle sizes: we are able to concentrate solids ranging from microns to nanometers, and it does not require that the solids be charged.

FIGS. 11A-11D show an experimental example of concentration of a liquid mixture according to an embodiment of the present invention. These diagrams are merely examples, which should not unduly limit the scope of the claims herein. One of ordinary skill in the art would recognize many variations, alternatives, and modifications. As shown, a series of images are provided for sample concentration of a solution containing 2 μm polystyrene beads (small dark spots to the left of the air bubble): (A) t=0 s, just after the air bubble has been formed; (B) t=14 s; (C) t=23 s; (D) t=38 s. In this experiment, Polystyrene beads, 2 microns in diameter (Polysciences Inc.) are added to de-ionized water (1:1000 ratio of polystyrene suspension to water by volume), and the mixture is used to partially fill the microchannels. The suspended particles are concentrated near the bubble edge by evaporative mass-transfer. From these images we calculate a factor of 20× increase in the particle concentration in 38 seconds in the volume near the interface. Note that the number of particles initially concentrated (visible dark patch within a marked white circle) that occurred as the free surface was dragged into position could not be resolved and was therefore not included in this estimate. There is no observed optical tweezing effect, which is consistent with the low numerical aperture of the 10× objective used (NA 0.3).

Figure 12:
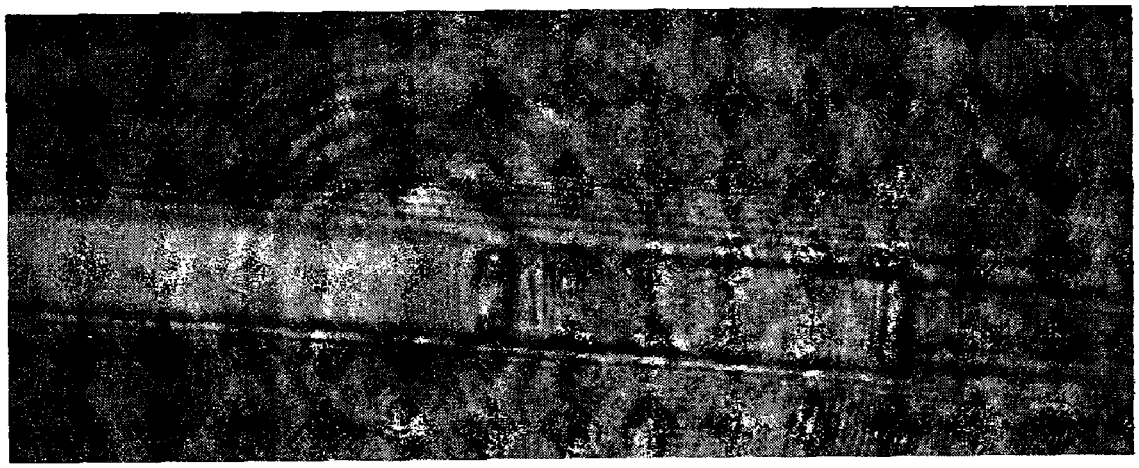
FIGS. 12A and 12B show another experimental example of concentration of a liquid mixture according to an embodiment of the present invention.
Figure 12:
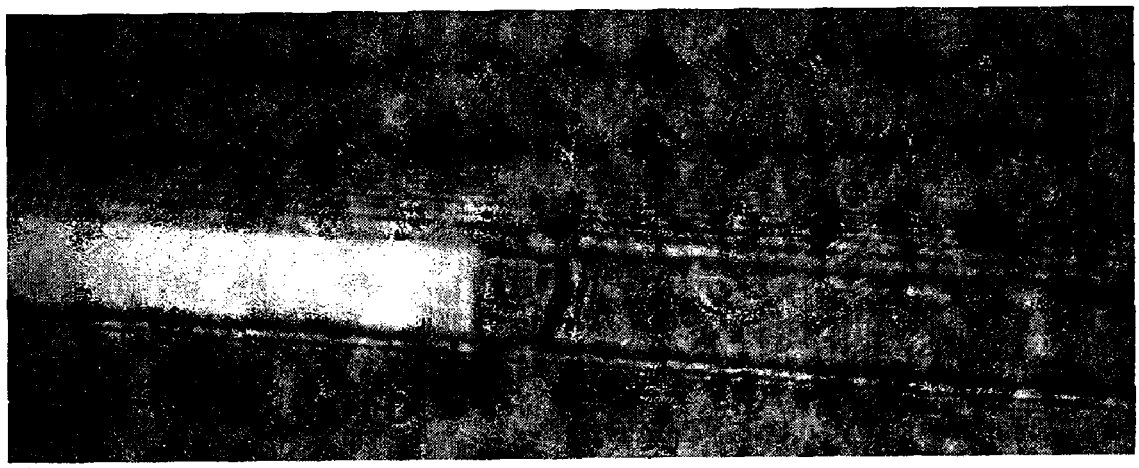

Additionally, embodiments of the present invention is also applicable to much smaller insoluble components, such as short strands of DNA. FIGS. 12A and 12B show another experimental example of concentration of a liquid mixture according to an embodiment of the present invention. These diagrams are merely examples, which should not unduly limit the scope of the claims herein. One of ordinary skill in the art would recognize many variations, alternatives, and modifications. As shown, a concentration of DNA in a liquid mixture is provided to the left of the air bubble in a 30 μm channel. In this experiment, oligomers of 20 base pairs each of which is labeled with a dye molecule are added to a mixture in a 30 μm channel. As shown in FIG. 12A, a fluorescent image of the channel just after the bubble has been formed. FIG. 12B is a fluorescent image of the channel after concentrating for 5 minutes, which corresponds to removing 0.057 picoliters of fluid from the solution and is visibly brighter. Mean values of the fluorescence signal are calculated by taking an average of a rectangular region of the channel 50×200 pixels in area. The increase in the measured fluorescence due to DNA concentration is 4.3 times in five minutes. During these measurements some errors due to photobleaching induced intensity reduction effect have been taking account by using minimal sampling times and properly corrected.

Figure 13:
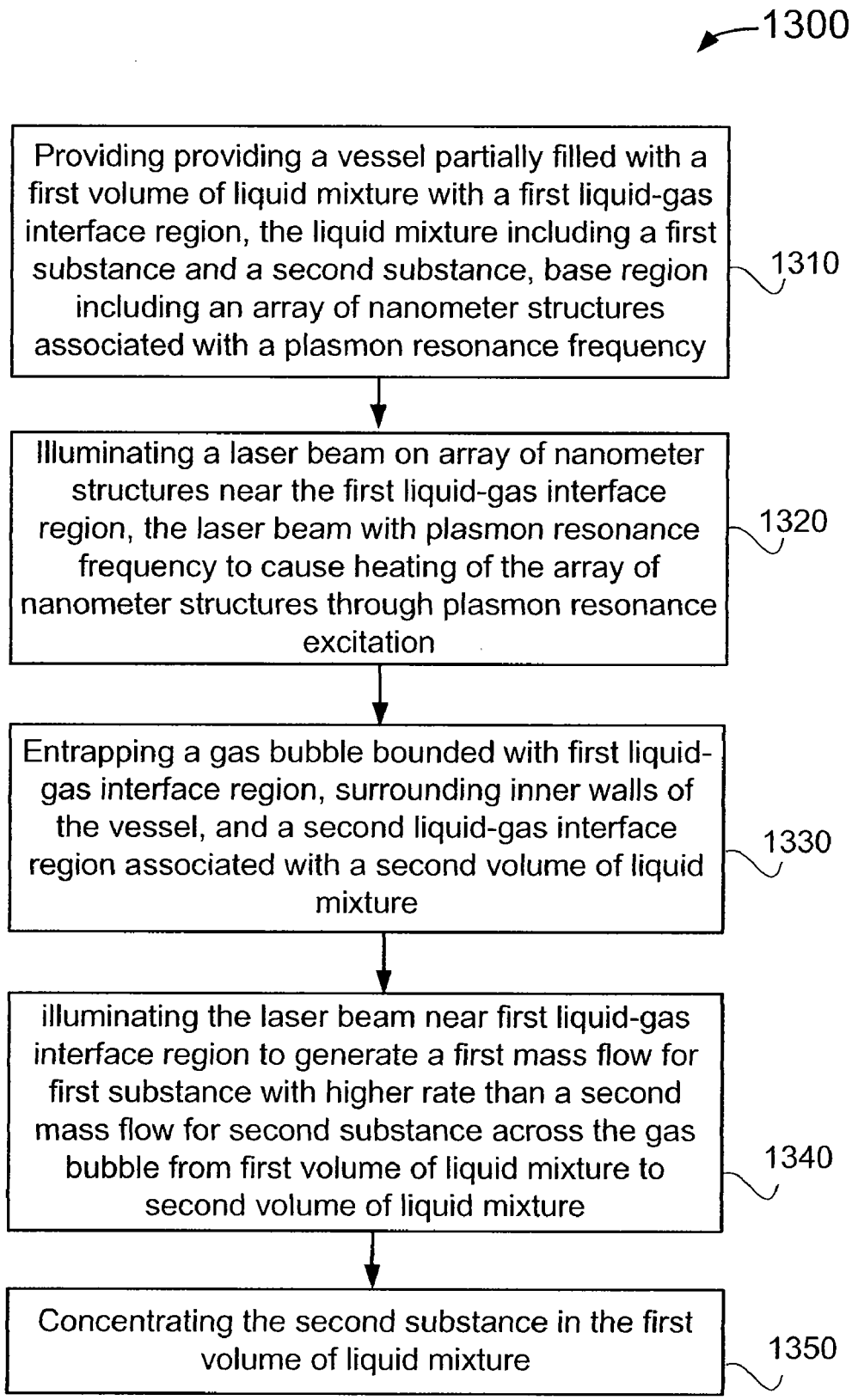
FIG. 13 is a simplified flowchart showing a method of concentrating a volume of liquid mixture in a micro-fluidic system according to an embodiment of the present invention.

FIG. 13 is a simplified flowchart summarizing a method of concentrating a volume of liquid mixture in a micro-fluidic system according to embodiments of the present invention. This diagrams is merely an example, which should not unduly limit the scope of the claims herein. One of ordinary skill in the art would recognize many variations, alternatives, and modifications. As shown, the invention provides a method 1300 including a process (1310) of providing a vessel partially filled with a first volume of liquid mixture separated from a gas by a first liquid-gas interface region. In a embodiment, the liquid mixture includes at least a first substance in a first concentration and a second substance in a second concentration. The first substance is characterized by a first volatility and the second substance is characterized by a second volatility. The second volatility is less than the first volatility. Further, the vessel characterized in micrometer scale includes a base region. In particular, the base region includes an array of nanometer structures associated with a plasmon resonance frequency range.

The method 1300 further includes a process (1320) of illuminating a laser beam on a portion of the array of nanometer structures within the first volume of liquid mixture substantially near the first liquid-gas interface region. The laser beam is characterized by a determined frequency within the plasmon resonance frequency range to cause plasmon resonance excitation and accelerated heating of the portion of the array of nanometer structures. In a specific embodiment, a laser beam with 14 mW power and 532 nm in wavelength is illuminated and focused onto an array of gold nanoparticles coated on the base region of the micrometer scaled vessel. The laser wavelength is selected to be within the plasmon resonance absorption band corresponding to the array of gold nanoparticles with an average diameter of about 15 nm and an average inter-particle spacing of about 50 nm. Thus, the laser beam, which is displaced within 10 microns of the first liquid-gas interface region, can induce accelerated photo-absorption and subsequently causes localized heating of a portion of the array of gold nanoparticles under illumination of the laser beam.

The method 1300, referring to FIG. 13, additionally includes a process (1330) of entrapping a gas bubble in the vessel by forming a second volume of liquid mixture at a distance in front of the first liquid-gas interface region through evaporation and recondensation during an energy transfer facilitated by the plasmon resonance excitation. The gas bubble is bounded by the first liquid-gas interface region, surrounding inner walls of the vessel, and a second liquid-gas interface region associated with the second volume of liquid mixture. This process further includes several steps. Firstly, it includes transferring heat from the portion of the array of gold nanoparticles to surrounding liquid near the first liquid-gas interface. Secondly, it includes directing the heat at least partially to latent heat of evaporation. Thirdly, it includes converting a portion liquid to vapor from the first liquid-gas interface. Then, it includes recondensing the vapor to nucleate one or more droplets which tend to grow into a liquid plug i.e., a second volume of liquid a distance away from the first liquid-gas interface, thereby trapping a gas bubble.

Referring again to FIG. 13, the method 1300 also includes a process (1340) of illuminating the laser beam on a portion of the array of nanometer structures within the first volume of liquid mixture substantially near the first liquid-gas interface region to generate a first mass flow for the first substance with a first flow rate and a second mass flow for the second substance with a second flow rate in the vessel across the gas bubble from first volume of liquid mixture to the second volume of liquid mixture. The first flow rate is higher than the second flow rate.

Moreover, the method 1300 includes a process (1350) of concentrating the second substance in the first volume of liquid mixture while maintaining the first volume of liquid mixture substantially at an ambient state during fractional increase of the second concentration and decrease of the first concentration. furthermore, the method further includes distillating the first substance in the second volume of liquid mixture being substantially free of the second substance. In certain embodiments, the method 1300 has been demonstrated to be applicable in experiments shown in FIGS. 9A-9D, 10A-10D, 11A-11D, and 12A-12B.

Figure 17:
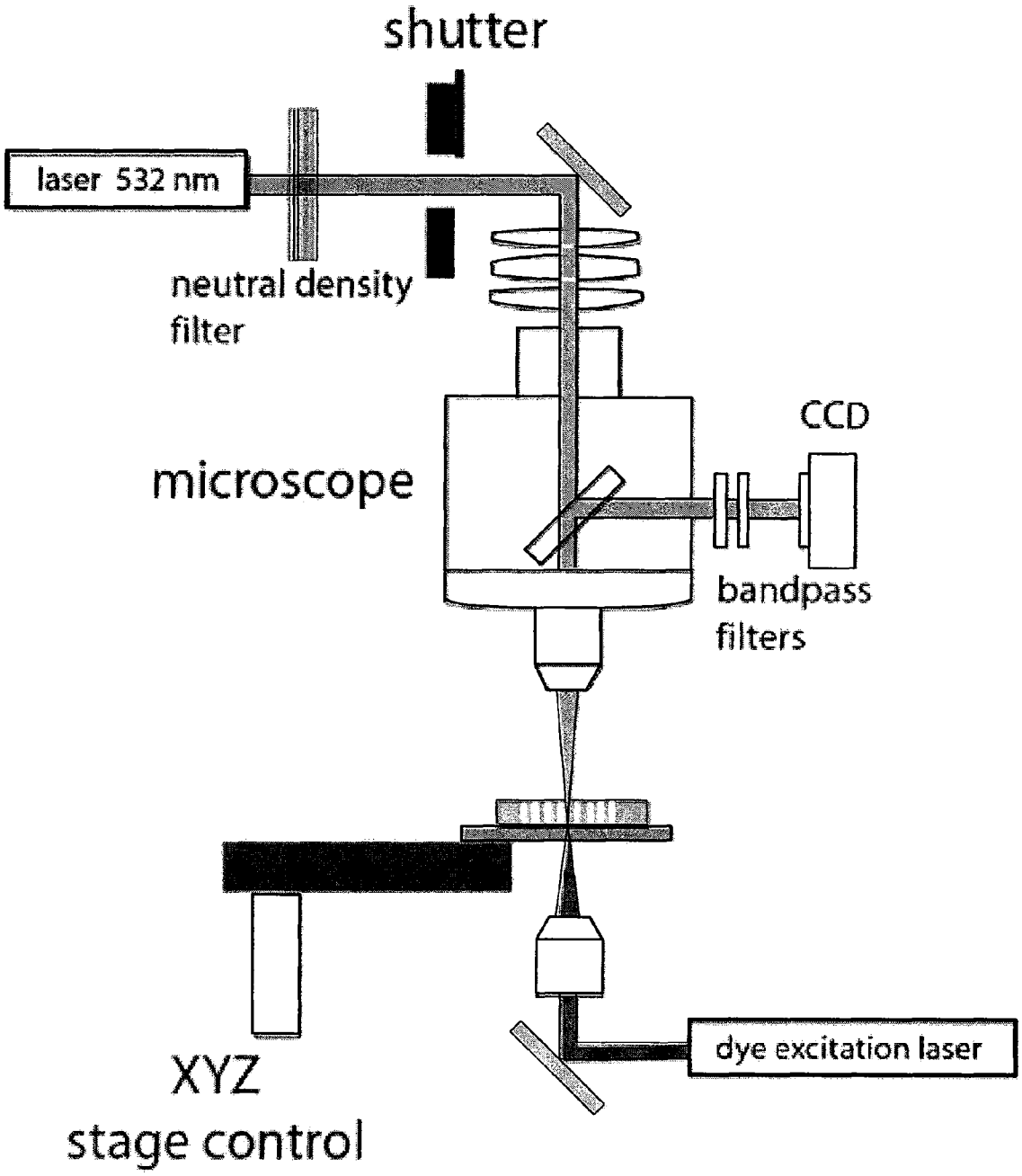
FIG. 17 shows an exemplary experimental setup according to embodiments of the present invention.

FIG. 17 shows an exemplary experimental setup based on which all experiments are carried out according to embodiments of the present invention. The microscope was equipped with a camera adaptor coupling a color CCD (Sony F-3103) through the eyepiece. Both white light for general illumination and a 532 nm laser diode (maximum power about 14 mW) were focused onto the substrate using the same 10× microscope objective. The reflected power was also measured from the other eye-piece using a Newport 1835C power meter. The 405 nm laser (not shown) used in the temperature-fluorescence measurements was passed through a monochromater before being brought-in from below the sample. The beam was focused with a 10× microscope objective. The sample was mounted on a computer controlled XYZ stage.

For the experiments shown above, fluid was injected into the microchannels using a syringe and a length of Tygon tubing (Cole-Palmer ID 0.092 inches). Channels were partially filled so the air-liquid interface was near the center of the device. The distillation studies were performed using a mixture of 0.1 M Coumarin 4 dye (peak emission 420 nm) in pure ethanol, with a temperature dependent buffer of HCL and tris (hydroxymethyl) aminomethane (Tris buffer). The pH of this mixture was adjusted via titration with added buffer solution to the point of maximum sensitivity with temperature. The dye was excited using a 405 nm solid state laser (5 mW) focused to the approximate field of view of the camera. Fluorescence images were recorded through a band pass filter centered around 420 nm (Semrock) with an exposure of 15 s. The maximum temperature sensitivity was calibrated using a thermocouple and a Peltier cooler, and was determined to be around 2° C. Fluorescence quenching was linearly proportional to temperature over a range of 25-55° C. We did not observe significant photo-bleaching of the solution.

For the pumping measurements, edge detection techniques were implemented into Matlab to determine the position of the leading fluid edge in still frames captured every 5 seconds. Linear fits were constructed using linear fitting algorithms, which are built into Matlab. In the distillation studies, Matlab was used to compare the fluorescence intensities between images by taking the mean of identical regions of pixels in each image and using only the blue channel of the CCD image.

For vapor pumping and distillation measurements, images of the channel were captured every 5 s during pumping. The position of the free surface with time was determined from the images using Matlab's edge detection techniques and built in linear fitting algorithms. In the distillation, fluorescence intensity was compared between images by taking the mean of identical regions of pixels in each image, using only the blue channel of the image. We found that the flow-rate due to BAIM pumping was sensitive to variations in the location of the beam focus, as well as variations in input energy density. To minimize these effects during the pumping studies, we examined the change in flow rate due to changes in input power for a constant beam location. After forming a stable bubble, the laser was switched off, and the beam position was adjusted to be approximately 20 μm behind the air bubble, on the fluid filled channel. We ran the laser at full power for 1 minute and then introduced a neutral density filter without stopping the laser. We allowed the flow to proceed for another minute at the reduced power.

For DNA concentration measurements, solutions of oligomer were prepared from a lyophilized sample provided by Alpha DNA Inc. The supplied oligomers were 20 bases long, and were prepared with a 5' modification of APC Cy5.5 dye (Glen Research). A concentrated stock solution was prepared by suspending the lyophilized DNA in TE buffer (pH 8.0). A working solution was prepared from the stock solution by addition of an annealing buffer (pH 8.0) to a final concentration of 160 nM. The working solution was injected in to a 30 μm wide microchannel. The fluorescence excitation source was a multimode He—Ne laser passed through a 633 nm bandpass filter (Edmund Optics). The power of the laser after the filter was measured at 10.7 mW. The laser spot was brought from beneath the sample directly onto the microchannel. The excitation flux through the channel was approximately 1×106 W/m$^2$. Fluorescence measurements were performed by imaging the channel through a microscope with a 10× objective, using a monochrome video camera (Sony XC-710). A long-pass wavelength filter was inserted into the optical system before the camera to reduce the excitation light recorded (685 nm cut-off filter, Melles Griot). To avoid excessive photobleaching, fluorescence images were captured both prior to and immediately after the evaporation process only. An air bubble was formed using the 532 nm laser in the manner described in the text, and a small quantity of liquid was transported across the bubble (50 μm). An initial image was captured before further evaporative transport was performed, using an exposure time of 2 s. The excitation light was manually un-shuttered during exposure, and then re-shuttered while evaporative transport was resumed. The evaporative transport was performed for 5 minutes, after which the 532 nm laser was shuttered and another fluorescence exposure was captured. The fluorescence images were analyzed using Matlab.

Many benefits are achieved by way of the present invention over conventional techniques. For example, the present invention provides a new class of on-chip functionality for microfluidics based on ambient temperature interphase mass-transfer. Excessive temperatures as high as about 60° C. in some conventional techniques are a concern for bio applications. Embodiments of the present invention avoid high temperatures by using of the freedom provided by microfluidics to heat liquid in the immediate vicinity of a liquid-vapor interface. In some embodiments, we have shown by means of experiment and a simple model that only a small change in the temperature of the fluid is required for the observed mass-transfer rates. According to Equation 1, we would not expect a high temperature increase for our system for the following reasons: 1) The measured absorption for the arrays is low, which is in consistent with the calculated value of $K_{abs}$ for a gold nanoparticle of diameter of 15 nm at 532 nm wavelength. Values of $K_{abs}$ for a strongly absorbing gold nanoparticle for this wavelength are nearly a factor of three larger. 2) The radius $r_0$ of the nanoparticles in the array is smaller by more than a factor of six than the particle size reported in a conventional suspension liquid. In one embodiment, the effect of the particle radius on the optical absorption is taken into account by parameter $K_{abs}$, and $r_0$ in Equation 1 is only related to the heat transfer from the particle to the surrounding medium.

The optical absorption $K_{abs}$ of a spherical nanoparticle in an array is not only related to the particle size but also the inter-particle spacing. As mentioned earlier, throughout these experiments arrays with an average particle diameter of about 14.5 nm and an average inter-particle spacing of about 46 nm were used. By decreasing the inter-particle spacing it should be possible to increase the total absorption for a given $r_0$. This would presumably increase the pumping rates for a given laser power at the expense of having the particles obtain higher temperatures. For the arrays having smaller, less absorptive particles, correspondingly more particles are needed to achieve the necessary heating for a given laser power.

The photothermal properties of the array, i.e. particle size and spacing, could be tailored to maximize mass-transfer for a given laser power while maintaining the temperature of the particles below acceptable levels. Wider channels and correspondingly wider laser spot i.e. a line source would allow a larger area and therefore an increase in mass flow. There are other factors that affect the pumping efficiency. The rate of the evaporative mass-transfer will be affected by the materials of the channel. PDMS is gas permeable, and eventually the gas in bubble will diffuse into the walls of the channel. Heat loss is also a consideration as the thermal conductivity of supporting glass is high and much of the heat imparted to the liquid from the nanoparticles is lost to the support. The evaporation process is not limited to plasmonic heating, and a light absorbing surface such as carbon black or even resistive heaters could in principle be used as a heat source. However, plasmonic heating has the advantage of an optical frequency dependence and does not limit the optical access at off-resonance frequencies. This is potentially useful for simultaneous application of other optical techniques such as fluorescence spectroscopy, which is widely used for studying biological systems and was demonstrated here.

Another advantage of the present invention lies in using plasmon assisted heating by illuminating a laser beam and is highly controllable. Unlike other optical transport methods, it does not require translation of the beam. The present invention provides a method for performing a microfluidic control on chip, though the price to pay for driving the process optically requires an external laser. However, advances in microelectronic fabrication allow for integration of microlasers on chip, and such an approach would minimize inconsistencies related to the distance of spot position and the surface of the gas bubble and would allow the technique to be scaled on-chip. The present invention have successfully demonstrated that the approach affords a simple on-chip means for pumping, distillation, and sample concentration. The technique is general and the functionality that it offers can be integrated with conventional microfluidic architectures and is believed to have a much broader range of applicability.

It is also understood that the examples and embodiments described herein are for illustrative purposes only and that various modifications or changes in light thereof will be suggested to persons skilled in the art and are to be included within the spirit and purview of this application and scope of the appended claims.

What is claimed is:

1. A method of microfluidic control via localized heating, the method comprising:

providing a microchannel structure with a base region, the microchannel structure being partially filled with a volume of liquid and a gas at an ambient temperature, the volume of liquid and the gas being separated by a liquid-gas interface region within the microchannel structure, the base region including one or more physical structures comprising a nanometer scale patterned metal film embedded on the base region and associated with a plasmon resonance absorption band;

supplying energy input to a portion of the one or more physical structures within the volume of liquid in a vicinity of the liquid-gas interface region to cause localized heating of the portion of the one or more physical structures;

transferring heat from the portion of the one or more physical structures to surrounding liquid in the vicinity of the liquid-gas interface region; and generating an interphase mass transport at the liquid-gas interface region in the microchannel structure, wherein the volume of liquid and the gas remain to be substantially at the ambient temperature.

2. The method of claim 1 wherein the microchannel structure comprises a body cast from polydimthylsiloxane (PMDS) that is sealed on the base region, the body including a width of about 20 μm or larger and a height of about 5 μm.

3. The method of claim 1 wherein the nanometer scale patterned metal film comprises an array of gold nanoparticles with an average particle size of about 15 nm and an average inter-particle spacing of about 50 nm.

4. The method of claim 1 wherein supplying energy input comprises illuminating electromagnetic radiation or supplying heat resistively or inducting through magnetic resonance.

5. The method of claim 4 wherein illuminating electromagnetic radiation comprises focusing a laser beam to a portion of the one or more physical structures within the volume of liquid in a vicinity of about 10 μm from the liquid-gas interface region.

6. The method of claim 5 wherein the laser beam comprises a frequency within the plasmon resonance absorption band corresponding to the one or more physical structures.

7. The method of claim 6 wherein the localized heating of the portion of the one or more physical structures is achieved through a plasmon resonance excitation by the focused laser beam with a power level of about 14 mW and a beam spot of about 10 μm.

8. The method of claim 1 wherein transferring heat from the portion of the one or more physical structures to surrounding liquid in a vicinity of the liquid-gas interface region comprises heating the surrounding liquid locally without allowing temperature rise more than about 2 degrees of Centigrade and transforming at least partially the heat into latent heat of vaporization of a portion of the surrounding liquid.

9. The method of claim 1 wherein generating an interphase mass transport at the liquid-gas interface region in the microchannel structure comprises, converting a portion of the surrounding liquid into a vapor;

driving the vapor out of the liquid-gas interface region;

condensing at least partially the vapor to form one or more liquid droplets nucleated in the microchannel structure in front of the liquid-gas interface region;

growing the one or more droplets to merge with the liquid-gas interface region; and displacing the liquid-gas interface region from a first position to a second position along the microchannel structure.

10. A method of plasmon resonance assisted microfluidic pumping, the method comprising:

providing a vessel partially filled with a first volume of liquid, said liquid being separated from a gas by a first liquid-gas interface region, the vessel characterized in micrometer scale including a base region, a width, and a height, the base region including an array of nanometer structures associated with a plasmon resonance frequency range;

illuminating a laser beam on a portion of the array of nanometer structures within the first volume of liquid substantially near the first liquid-gas interface region, the laser beam being characterized by a power level and a determined frequency within the plasmon resonance frequency range to cause plasmon resonance excitation of the portion of the array of nanometer structures;

entrapping a gas bubble in the vessel by forming a second volume of liquid at a distance in front of the first liquid-gas interface region through evaporation and recondensation during an energy transfer facilitated by the plasmon resonance excitation, the gas bubble being bounded by the first liquid-gas interface region, surrounding inner walls of the vessel, and a second liquid-gas interface region associated with the second volume of liquid; and generating a mass transport in the vessel across the gas bubble from first liquid-gas interface region to the second liquid-gas interface region.

11. The method of claim 10 wherein the vessel comprises a microchannel structure cast from polydimthylsiloxane (PMDS) that is sealed on the base region, the width being about 20 μm or larger and the height being about 5 μm.

12. The method of claim 10 wherein the array of nanometer structures comprises a plurality of metal particles having an average diameter of about 15 nm, an average inter-particle spacing of about 50 nm, and being associated with a plasmon resonance absorption band ranging from 500 nm to 580 nm.

13. The method of claim 12 wherein illuminating a laser beam on a portion of the array of nanometer structures within the first volume of liquid substantially near the first liquid-gas interface region comprises applying a laser beam with a power of about 14 mW and a 532 nm wavelength focused on a first plurality of metal nanoparticles on the base region located within 10 μm from the first liquid-gas interface region.

14. The method of claim 10 wherein entrapping a gas bubble in the vessel by forming a second volume of liquid at a distance in front of the first liquid-gas interface region comprises converting a portion of the first volume of liquid from the first liquid-gas interface region into a vapor;

condensing the vapor to form one or more droplets on inner walls of the vessel at the distance in front of the first liquid-gas interface region;

growing the one or more droplets together to form the second volume of liquid with the second liquid-gas interface region located at the distance in front of the first liquid-gas interface region; and maintaining the gas bubble and the first volume of liquid substantially at an ambient temperature and pressure.

15. The method of claim 10 wherein generating a mass transport in the vessel across the gas bubble from first liquid-gas interface region to the second liquid-gas interface region comprises:

illuminating the laser beam on the portion of the array of nanometer structures within the first volume of liquid near the first liquid-gas interface region;

transforming heat at least partially to a latent heat of evaporation of a portion of the first volume of liquid at the first liquid-gas interface region while keeping temperature increase of the portion of the first volume of liquid less than 2 degrees of Centigrade;

converting the portion of the first volume of liquid to a vapor into the gas bubble; and thereafter condensing the vapor at the second liquid-gas interface region;

wherein, the laser beam is substantially stationary relative to the vessel and the first liquid-gas interface region;

the gas bubble keeps a substantially stable size defined by a spacing between the first liquid-gas interface region and the second liquid-gas interface region during the mass transport in the vessel after an earlier shrinkage within a certain amount of time of illuminating the laser beam;

the stable size of the gas bubble corresponds to a steady state pumping rate for the mass transport from the first volume of liquid to the second volume of liquid;

the steady state pumping rate is substantially constant with time and linear with the power level of laser beam.

16. A method of concentrating a volume of liquid mixture in a micro-fluidic system, the method comprising:

providing a vessel partially filled with a first volume of liquid mixture separated from a gas by a first liquid-gas interface region, the liquid mixture including at least a first substance in a first concentration and a second substance in a second concentration, the first substance being characterized by a first volatility and the second substance being characterized by a second volatility, the second volatility being less than the first volatility, the vessel characterized in micrometer scale including a base region, the base region including an array of nanometer structures associated with a plasmon resonance frequency range;

illuminating a laser beam on a portion of the array of nanometer structures within the first volume of liquid mixture substantially near the first liquid-gas interface region, the laser beam being characterized by a determined frequency within the plasmon resonance frequency range to cause plasmon resonance excitation of the portion of the array of nanometer structures;

entrapping a gas bubble in the vessel by forming a second volume of liquid mixture at a distance in front of the first liquid-gas interface region through evaporation and recondensation during an energy transfer facilitated by the plasmon resonance excitation, the gas bubble being bounded by the first liquid-gas interface region, surrounding inner walls of the vessel, and a second liquid-gas interface region associated with the second volume of liquid mixture;

illuminating the laser beam on a portion of the array of nanometer structures within the first volume of liquid mixture substantially near the first liquid-gas interface region to generate a first mass flow for the first substance with a first flow rate and a second mass flow for the second substance with a second flow rate in the vessel across the gas bubble from first volume of liquid mixture to the second volume of liquid mixture, the first flow rate being higher than the second flow rate; and concentrating the second substance in the first volume of liquid mixture while maintaining the first volume of liquid mixture substantially at an ambient state during fractional increase of the second concentration and decrease of the first concentration.

17. The method of claim 16 wherein the array of nanometer structures comprises an array of gold nanoparticles with an average size of about 15 nm and an average inter-particle spacing of about 50 nm formed on the base region by block co-polymer lithography.

18. The method of claim 16 further comprising distillating the first substance in the second volume of liquid mixture being substantially free of the second substance.

19. A method of concentrating a substance within a volume of liquid in a microfluidic system, the method comprising:

providing a vessel partially filled with a first volume of liquid separated from air by a first liquid-air interface region in an ambient state, the first volume of liquid including a first concentration of a substance characterized as a plurality of suspended molecules, the vessel characterized in micrometer scale including a base region, the base region including an array of metal nanoparticles associated with a plasmon resonance frequency range;

illuminating a laser beam on a portion of the array of metal nanoparticles within the first volume of liquid substantially near the first liquid-air interface region, the laser beam being characterized by a determined frequency within the plasmon resonance frequency range to cause plasmon resonance excitation of the portion of the array of metal nanoparticles;

entrapping an air bubble in the vessel by forming a second volume of liquid at a distance in front of the first liquid-air interface region through liquid evaporation and recondensation during an energy transfer facilitated by the plasmon resonance excitation, the air bubble being bounded by the first liquid-air interface region, surrounding inner walls of the vessel, and a second liquid-air interface region associated with the second volume of liquid;

illuminating the laser beam on a portion of the array of metal nanoparticles within the first volume of liquid substantially near the first liquid-air interface region to generate a mass flow for the liquid in the vessel across the air bubble from the first liquid-air interface region to the second liquid-air interface region; and concentrating the substance suspended within the first volume of liquid to increase the first concentration to a second concentration while maintaining the first volume of liquid substantially at an ambient state.

* * * * *